US010378344B2

(12) United States Patent
Al-Dosary et al.

(10) Patent No.: US 10,378,344 B2
(45) Date of Patent: Aug. 13, 2019

(54) FORMATION SKIN EVALUATION

(71) Applicant: Schlumberger Technology Corporation, Sugar Land, TX (US)

(72) Inventors: Abdulrahman Adel Al-Dosary, Udhailiyah (SA); Ramy Ahmed, Dammam (SA)

(73) Assignee: Schlumberger Technology Corporation, Sugar Land, TX (US)

( * ) Notice: Subject to any disclaimer, the term of this patent is extended or adjusted under 35 U.S.C. 154(b) by 215 days.

(21) Appl. No.: 15/123,779

(22) PCT Filed: Mar. 6, 2015

(86) PCT No.: PCT/US2015/019152
§ 371 (c)(1),
(2) Date: Sep. 6, 2016

(87) PCT Pub. No.: WO2015/134857
PCT Pub. Date: Sep. 11, 2015

(65) Prior Publication Data

US 2017/0183963 A1 Jun. 29, 2017

Related U.S. Application Data

(60) Provisional application No. 61/949,143, filed on Mar. 6, 2014.

(51) Int. Cl.
*E21B 49/00* (2006.01)
*E21B 47/06* (2012.01)
(Continued)

(52) U.S. Cl.
CPC ..... *E21B 49/00* (2013.01); *E21B 43/26* (2013.01); *E21B 47/06* (2013.01); *E21B 47/065* (2013.01); *E21B 49/008* (2013.01); *E21B 43/267* (2013.01)

(58) Field of Classification Search
CPC ..... E21B 49/00; E21B 43/26; E21B 47/06; E21B 47/065; E21B 49/008; E21B 43/167; E21B 47/00; G06F 9/455; G01F 13/00
See application file for complete search history.

(56) References Cited

U.S. PATENT DOCUMENTS 4,799,157 A 1/1989 Kucuk et al.
4,862,962 A 9/1989 Prouvost et al.
(Continued)

FOREIGN PATENT DOCUMENTS

CN 101906966 A 12/2010
WO 1995/17581 A1 6/1995
WO 2012087864 A2 6/2012

OTHER PUBLICATIONS

International Preliminary Report on Patentability for the equivalent International patent application PCT/US2015/019152 dated Sep. 15, 2016.

(Continued)

*Primary Examiner* — Yong-Suk Ro
(74) *Attorney, Agent, or Firm* — Mitchell M. Blakely

(57) ABSTRACT

A method can include receiving formation parameter values associated with a bore of a formation via a pressure transient analysis of a test performed by tubing that is operatively coupled to a tool that includes at least one pressure sensor. The method can include receiving a pressure stabilization value for fluid flow at a location in the bore of the formation. And, the method can include, based at least in part on the formation parameter values and the pressure stabilization value, calculating a skin factor value for the location in the bore.

20 Claims, 17 Drawing Sheets

(51) Int. Cl.
*E21B 43/26* (2006.01)
*E21B 43/267* (2006.01)

(56) References Cited

U.S. PATENT DOCUMENTS

| | | | | |
|---|---|---|---|---|
| 5,458,192 | A * | 10/1995 | Hunt | E21B 43/26 166/250.1 |
| 7,055,604 | B2 | 6/2006 | Jee et al. | |
| 7,181,960 | B2 | 2/2007 | Sheng et al. | |
| 2010/0026293 | A1 | 2/2010 | Minh | |
| 2012/0103601 | A1 | 5/2012 | Shako et al. | |

OTHER PUBLICATIONS

Extended Search Report for the equivalent European patent application 15758578.7 dated Sep. 26, 2017.
PCT/US2015/019152 PCT International Search Report and Written Opinion, dated Jun. 18, 2015, 16 pgs.

* cited by examiner

Scenario 1100

Table 1500

| depth | dX | QInj | Pinj | Pinj' | dPs | dps' | S | S' | S% |
|---|---|---|---|---|---|---|---|---|---|
| ft | ft | bbl/min | psi | psi | psi | psi | | | |
| 14052.7 | 100 | 2 | 5969 | 5929 | -68.08 | -73.88 | -0.08 | -0.09 | 9% |
| 13952.7 | | 2 | 5980 | 5952 | -79.08 | -96.88 | -0.10 | -0.12 | 23% |
| 13852.7 | 100 | 2 | 6000 | 5963 | -99.08 | -107.88 | -0.12 | -0.13 | 9% |
| 13752.7 | | 2 | 6010 | 5966 | -109.08 | -110.88 | -0.13 | -0.13 | 2% |
| 13652.7 | 100 | 2 | 6027 | 5980 | -126.08 | -124.88 | -0.15 | -0.15 | 0% |
| 13552.7 | | 2 | 6027 | 5987 | -126.08 | -131.88 | -0.15 | -0.16 | 5% |
| 13452.7 | 100 | 2 | 6030 | 5961 | -129.08 | -105.88 | -0.16 | -0.13 | 0% |
| **13352.7** | | **2** | **5927** | **5958** | **-26.08** | **-102.88** | **-0.03** | **-0.12** | **294%** |
| **13252.7** | **100** | **2** | **5926** | **5967** | **-25.08** | **-111.88** | **-0.03** | **-0.14** | **346%** |
| **13152.7** | | **2** | **5922** | **5965** | **-21.08** | **-109.88** | **-0.03** | **-0.13** | **421%** |
| **13052.7** | **100** | **2** | **5921** | **5963** | **-20.08** | **-107.88** | **-0.02** | **-0.13** | **437%** |
| 12952.7 | | 2 | 5989 | 5966 | -88.08 | -110.88 | -0.11 | -0.13 | 26% |
| 12852.7 | 100 | 2 | 6001 | 5967 | -100.08 | -111.88 | -0.12 | -0.14 | 12% |
| 12752.7 | | 2 | 6008 | 5972 | -107.08 | -116.88 | -0.13 | -0.14 | 9% |
| 12652.7 | 100 | 2 | 6018 | 5977 | -117.08 | -121.88 | -0.14 | -0.15 | 4% |
| 12552.7 | | 2 | 6019 | 5975 | -118.08 | -119.88 | -0.14 | -0.15 | 2% |
| 12452.7 | 100 | 2 | 6024 | 5978 | -123.08 | -122.88 | -0.15 | -0.15 | 0% |
| 12352.7 | | 2 | 6028 | 5981 | -127.08 | -125.88 | -0.15 | -0.15 | 0% |

Fig. 15

Table 1660

| | AJ | Q | B | u | Pi | R | KH |
|---|---|---|---|---|---|---|---|
| | | STBD | bbl/STB | cp | psi | | md-ft |
| Pre | 0.001215 | 2880 | 1 | 1 | 5900.92 | 406656 | 494 |
| Post | 0.002363 | 2880 | 1 | 1 | 5855.12 | 406656 | 961 |

FORMATION SKIN EVALUATION

RELATED APPLICATIONS

This application claims priority to and the benefit of a U.S. provisional application having Ser. No. 61/949,143, filed 6 Mar. 2014, which is incorporated by reference herein.

BACKGROUND

Resources may exist in subterranean fields that span large geographic areas. As an example, hydrocarbons may exist in a basin that may be a depression in the crust of the Earth, for example, caused by plate tectonic activity and subsidence, in which sediments accumulate (e.g., to form a sedimentary basin). Hydrocarbon source rock may exist in a basin in combination with appropriate depth and duration of burial such that a so-called "petroleum system" may develop within the basin. Various technologies, techniques, etc. described herein may facilitate assessment of a basin and, for example, development of a basin for production of one or more types of resources.

SUMMARY

In accordance with some embodiments, a method includes receiving formation parameter values associated with a bore of a formation; receiving a pressure stabilization value for fluid flow at a location in the bore of the formation; and, based at least in part on the formation parameter values and the pressure stabilization value, calculating a skin factor value for the location in the bore.

In some embodiments, an aspect of a method includes receiving formation parameter values that include at least one formation capacity value.

In some embodiments, an aspect of a method includes receiving formation parameter values that include at least one calculated formation pressure value that is calculated based at least in part on a plurality of measured formation pressure values.

In some embodiments, an aspect of a method includes receiving formation parameter values that include at least one formation capacity value and at least one average formation pressure value.

In some embodiments, an aspect of a method includes receiving a pressure stabilization value that is a relatively constant pressure value with respect to time as measured during flow of fluid at a location in a bore.

In some embodiments, an aspect of a method includes receiving a plurality of pressure stabilization values for fluid flow at a plurality of locations in a bore of a formation and calculating a plurality of skin factor values for the plurality of locations in the bore.

In some embodiments, an aspect of a method includes storing a plurality of skin factor values as a fingerprint that characterizes a bore where the bore may be, for example, one of a plurality of lateral bores that join a common bore.

In some embodiments, an aspect of a method includes receiving distributed temperature survey data for at least a portion of a bore and comparing a skin factor value to at least a portion of the distributed temperature survey data.

In some embodiments, an aspect of a method includes treating at least a portion of a bore, receiving formation parameter values associated with the treated portion of the bore, receiving a pressure stabilization value for fluid flow at a location in the treated portion of the bore and, based at least in part on the formation parameter values associated with the treated portion of the bore and the pressure stabilization value for fluid flow at the location in the treated portion of the bore, calculating a skin factor value for the location in the treated portion of the bore.

In some embodiments, an aspect of a method includes comparing a pre-treatment skin factor value for a location in a bore to a skin factor value for the location in a treated portion of the bore where the locations are within a predetermined distance from each other (e.g., consider an error distance of the order of tens of feet or less or, for example, of the order of about 10 m or less).

In some embodiments, an aspect of a method includes a formation parameter value that is a pressure value and calculating a skin factor value at least in part by calculating a difference between the pressure value and a pressure stabilization value.

In accordance with some embodiments, a system is provided that includes a processor; memory operatively coupled to the processor; and instructions stored in the memory and executable by the processor to receive formation parameter values associated with a bore of a formation; receive a pressure stabilization value for fluid flow at a location in the bore of the formation; and, based at least in part on the formation parameter values and the pressure stabilization value, calculate a skin factor value for the location in the bore.

In some embodiments, an aspect of a system includes instructions to receive a plurality of pressure stabilization values for fluid flow at a plurality of locations in a bore of a formation and instructions to calculate a plurality of skin factor values for the plurality of locations in the bore.

In some embodiments, an aspect of a system includes instructions for storing a plurality of skin factor values as a fingerprint that characterizes a bore where, for example, the bore is one of a plurality of lateral bores that join a common bore.

In some embodiments, an aspect of a system includes instructions to receive distributed temperature survey data for at least a portion of a bore and instructions to compare a skin factor value to at least a portion of the distributed temperature survey data.

In some embodiments, an aspect of a system includes a formation parameter value that is a pressure value and instructions to calculate a skin factor value that include instructions to calculate a difference between the pressure value and a pressure stabilization value.

In accordance with some embodiments, at least one computer-readable medium is provided that includes processor-executable instructions that instruct a computing device where the instructions include instructions to instruct the computing device to: receive formation parameter values associated with a bore of a formation; receive a pressure stabilization value for fluid flow at a location in the bore of the formation; and, based at least in part on the formation parameter values and the pressure stabilization value, calculate a skin factor value for the location in the bore.

In some embodiments, an aspect of a computer readable storage medium includes instructions to receive a plurality of pressure stabilization values for fluid flow at a plurality of locations in a bore of a formation and instructions to calculate a plurality of skin factor values for the plurality of locations in the bore.

In some embodiments, an aspect of a computer readable storage medium includes instructions to store a plurality of skin factor values as a fingerprint that characterizes a bore where, for example, the bore is one of a plurality of lateral bores that join a common bore.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

FIG. 15 illustrates an example of a table that includes data;

DETAILED DESCRIPTION

Figure 1:
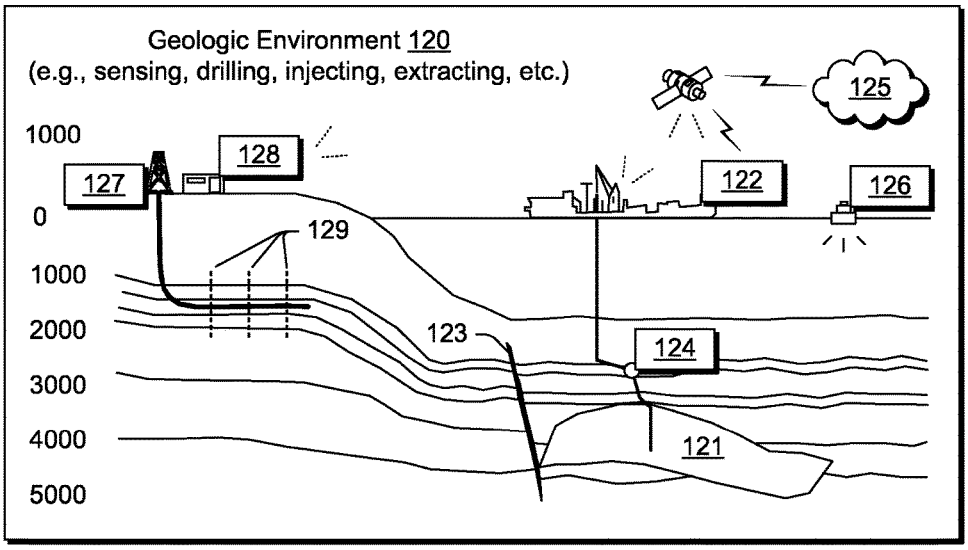
FIG. 1 illustrates examples of equipment in a geologic environment.

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

As an example, a system may be provided for positioning at least partially in a bore in a geologic environment. As an example, such a bore may be, for example, a lateral bore (e.g., non-vertical, horizontal, etc.). For example, a bore may be a bore suitable for stimulation of a portion of a geologic environment. As an example, stimulation may include one or more of fracturing, chemical treatment, pressure treatment, etc. As an example, stimulation may be a stimulation treatment.

As an example, a system may include components for acquiring data (e.g., signals, etc.) while at least in part disposed in a bore where at least a portion of that data may be processed to determine, for example, one or more values associated with skin. As an example, skin may be considered to be zone of reduced or enhanced permeability adjacent to a bore. As an example, skin may be explained, in part, by one or more of formation damage, mud-filtrate invasion during drilling or perforating, stimulation, etc.

As an example, a method may include determining one or more skin factor values. As an example, a skin factor may be a numerical value related to a difference from a pressure drop predicted by Darcy's law (e.g., or other model) due to skin. As an example, a skin factor value may be a value in a range from about −6 (e.g., for an infinite-conductivity massive hydraulic fracture) to more than about 100 (e.g., for a poorly executed gravel pack).

An equation for a skin factor may depend on a permeability thickness parameter (e.g., a formation capacity parameter). For example, consider a permeability thickness parameter denoted as KH. Such a parameter may be the product of formation permeability, k, and formation thickness, h (e.g., as associated with fluid production, etc.). As an example, a method may include receiving a value for KH, receiving a total pressure drop value (e.g., X psi or X kPa) that is related to skin effect for a bore in a geologic environment and determining a skin factor value based at least in part on the KH value and the total pressure drop value. As an example, for a given pressure drop value associated with skin effect, skin factor will increase as KH increases (e.g., proportionally).

As an example, a method may include determining a skin factor value and, for example, adjusting one or more stimulation parameter values based at least in part on the skin factor value. As an example, a method may include determining a skin factor value in real-time. For example, equipment may be positioned in a bore in a geologic environment where data may be acquired using the equipment during delivery of a stimulation technique (e.g., a treatment). In such an example, skin factor values may be determined based at least in part on acquired data to demonstrate results achieved via delivery of the stimulation technique. For example, where the stimulation technique is delivered in a manner that advances in space with respect to time, skin factor values may be provided that reflect the results of the stimulation technique in real-time (e.g., near real-time, accounting for computational time). For example, skin factor values may be provided on a foot by foot basis, a meter by meter basis and/or other basis during delivery of a stimulation technique (e.g., a minute by minute basis, etc.).

As an example, one or more stimulation parameters may be adjusted based at least in part on data associated with skin effect. For example, skin effect data may be used to determine skin factor values where such skin factor values are implemented in a method that may estimate a volume of a stimulation fluid for delivery to a geologic environment via a particular location in a bore. As an example, a method may include optimizing a bore testing program.

As an example, a method may be an in situ skin estimation method. As an example, a system may include components for performing an in situ skin estimation method.

As an example, a method may provide for in situ skin evaluation (ISE), optionally in real-time, for example, for output of measurement-based formation damage per unit of depth/distance in a bore (e.g., consider a horizontal openhole section, etc.). In such an example, formation damage may be based at least in part on measured pressure, for example, via one or more sensors carried by a conveyance tool where the conveyance tool may allow fluid to be pumped into a formation (e.g., in a continuous manner) while recording pressure. For example, equipment may be configured to pump fluid and measure pressure, optionally simultaneously. In such an example, skin information may be determined based at least in part on measured pressure. As an example, pumping of fluid may be adjusted based at least in part on determined skin information (e.g., at least in part on measured pressure).

As an example, a method may include determining a skin profile, optionally in real-time. For example, in a geologic environment, real-time may be associated with a process such as delivery of a stimulation technique, movement of equipment in a bore, etc. Such processes may, for example, have a time scale of the order of seconds or minutes. As an example, a real-time method may provide skin information on a time scale of the order of second or minutes. As an example, a method may, via determination of skin information, help to diminish uncertainty related to formation damage. As an example, a stimulation program may be optionally adjusted (e.g., planned, modified, etc.) on a time scale corresponding to a time scale of determined skin information. For example, where skin information is determined in real-time, a stimulation program may be adjusted in real-time based at least in part on such information. As an example, an adjustment to a stimulation program may aim to target a most damaged zone and thereby help to optimize time and resources.

FIG. 1 shows an example of a geologic environment 120. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with any of a variety of sensors, detectors, actuators, etc. For example, equipment 122 may include communication circuitry to receive and to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more pieces of equipment may provide for measurement, collection, communication, storage, analysis, etc. of data (e.g., for one or more produced resources, etc.). As an example, one or more satellites may be provided for purposes of communications, data acquisition, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

FIG. 1 also shows the geologic environment 120 as optionally including equipment 127 and 128 associated with a well that includes a substantially horizontal portion (e.g., or portions) that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, injection, production, etc. As an example, the equipment 127 and/or 128 may provide for measurement (e.g., temperature, pressure, etc.), collection, communication, storage, analysis, etc. of data such as, for example, production data (e.g., for one or more produced resources). As an example, one or more satellites may be provided for purposes of communications, data acquisition, etc.

Geologic formations such as in, for example, the geologic environment 120, include rock, which may be characterized by, for example, porosity values and by permeability values. Porosity may be defined as a percentage of volume occupied by pores, void space, volume within rock that can include fluid, etc. Permeability may be defined as an ability to transmit fluid, measurement of an ability to transmit fluid, etc.

As an example, rock may include clastic material, carbonate material and/or other type of material. As an example, clastic material may be material that includes broken fragments derived from preexisting rocks and transported elsewhere and redeposited before forming another rock. Examples of clastic sedimentary rocks include siliciclastic rocks such as conglomerate, sandstone, siltstone and shale. As an example, carbonate material may include calcite ($CaCo_3$), aragonite ($CaCo_3$) and/or dolomite ($CaMg(CO_3)_2$), which may replace calcite during a process known as dolomitization. Limestone, dolostone or dolomite, and chalk are some examples of carbonate rocks. As an example, carbonate material may be of clastic origin. As an example, carbonate material may be formed through processes of precipitation or the activity of organisms (e.g., coral, algae, etc.). Carbonates may form in shallow and deep marine settings, evaporitic basins, lakes, windy deserts, etc. Carbonate material deposits may serve as hydrocarbon reservoir rocks, for example, where porosity may have been enhanced through dissolution. Fractures can increase permeability in carbonate material deposits.

The term "effective porosity" may refer to interconnected pore volume in rock, for example, that may contribute to fluid flow in a formation. As effective porosity aims to exclude isolated pores, effective porosity may be less than total porosity. As an example, a shale formation may have relatively high total porosity yet relatively low permeability due to how shale is structured within the formation.

As an example, shale may be formed by consolidation of clay- and silt-sized particles into thin, relatively impermeable layers. In such an example, the layers may be laterally extensive and form caprock. Caprock may be defined as relatively impermeable rock that forms a barrier or seal with respect to reservoir rock such that fluid does not readily migrate beyond the reservoir rock. As an example, the permeability of caprock capable of retaining fluids through geologic time may be of the order of about $10^{-6}$ to about $10^{-8}$ D (darcies).

The term "shale" may refer to one or more types of shales that may be characterized, for example, based on lithology, etc. In shale gas formations, gas storage and flow may be related to combinations of different geophysical processes. For example, regarding storage, natural gas may be stored as compressed gas in pores and fractures, as adsorbed gas (e.g., adsorbed onto organic matter), and as soluble gas in solid organic materials.

Gas migration and production processes in gas shale sediments can occur, for example, at different physical scales. As an example, production in a newly drilled wellbore may be via large pores through a fracture network and then later in time via smaller pores. As an example, during reservoir depletion, thermodynamic equilibrium among kerogen, clay and the gas phase in pores can change, for example, where gas begins to desorb from kerogen exposed to a pore network.

Sedimentary organic matter tends to have a high sorption capacity for hydrocarbons (e.g., adsorption and absorption processes). Such capacity may depend on factors such as, for example, organic matter type, thermal maturity (e.g., high maturity may improve retention) and organic matter chemical composition. As an example, a model may characterize a formation such that a higher total organic content corresponds to a higher sorption capacity.

With respect to a formation that includes hydrocarbons (e.g., a hydrocarbon reservoir), its hydrocarbon producing potential may depend on various factors such as, for example, thickness and extent, organic content, thermal maturity, depth and pressure, fluid saturations, permeability, etc. As an example, a formation that includes gas (e.g., a gas reservoir) may include nanodarcy matrix permeability (e.g., of the order of $10^{-9}$ D) and narrow, calcite-sealed natural fractures. In such an example, technologies such as stimulation treatment may be applied in an effort to produce gas from the formation, for example, to create new, artificial fractures, to stimulate existing natural fractures (e.g., reactivate calcite-sealed natural fractures), etc. (see, e.g., the one or more fractures 129 in the geologic environment 120 of FIG. 1).

Material in a geologic environment may vary by, for example, one or more of mineralogical characteristics, formation grain sizes, organic contents, rock fissility, etc. Attention to such factors may aid in designing an appropriate stimulation treatment. For example, an evaluation process may include well construction (e.g., drilling one or more vertical, horizontal or deviated wells), sample analysis (e.g., for geomechanical and geochemical properties), openhole logs (e.g., petrophysical log models) and post-fracture evaluation (e.g., production logs). Effectiveness of a stimulation treatment (e.g., treatments, stages of treatments, etc., may determine flow mechanism(s), well performance results, etc.

As an example, a stimulation treatment may include pumping fluid into a formation via a wellbore at pressure and rate sufficient to cause a fracture to open. Such a fracture may be vertical and include wings that extend away from the wellbore, for example, in opposing directions according to natural stresses within the formation. As an example, proppant (e.g., sand, etc.) may be mixed with treatment fluid to deposit the proppant in the generated fractures in an effort to maintain fracture width over at least a portion of a generated fracture. For example, a generated fracture may have a length of about 500 ft (e.g., about 150 m) extending from a wellbore where proppant maintains a desirable fracture width over about the first 250 ft (e.g., about 75 m) of the generated fracture.

In a stimulated gas formation, fracturing may be applied over or within a region deemed a "drainage area" (e.g., consider at least one well with at least one artificial fracture), for example, according to a development plan. In such a formation, gas pressure (e.g., within the formation's "matrix") may be higher than in generated fractures of the drainage area such that gas flows from the matrix to the generated fractures and onto a wellbore. During production of the gas, gas pressure in a drainage area tends to decrease (e.g., decreasing the driving force for fluid flow, for example, per Darcy's law, Navier-Stokes equations, etc.). As an example, gas production from a drainage area may continue for decades; however, the predictability of decades long production (e.g., a production forecast) can depend on many factors, some of which may be uncertain (e.g., unknown, unknowable, estimated with probability bounds, etc.).

Figure 2:
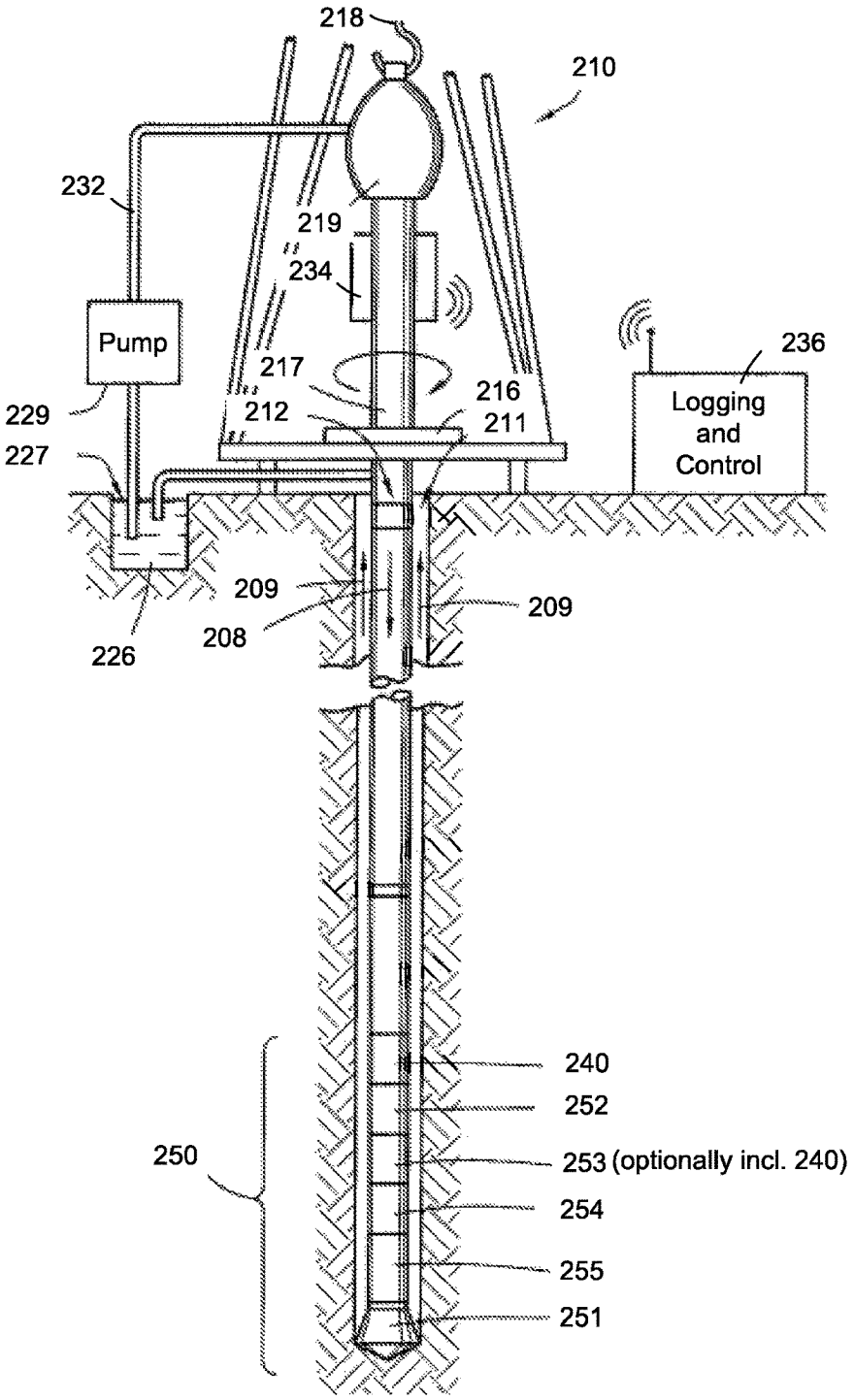
FIG. 2 illustrates examples of equipment.

FIG. 2 shows a wellsite system (e.g., at a wellsite that may be onshore or offshore). In the example system of FIG. 2, a borehole 211 is formed in subsurface formations by rotary drilling; noting that various example embodiments may also use directional drilling. As shown, a drill string 212 is suspended within the borehole 211 and has a bottom hole assembly 250 that includes a drill bit 251 at its lower end. A surface system provides for operation of the drill string 212 and other operations and includes platform and derrick assembly 210 positioned over the borehole 211, the assembly 210 including a rotary table 216, a kelly 217, a hook 218 and a rotary swivel 219. As indicated by an arrow, the drill string 212 can be rotated by the rotary table 216, energized by means not shown, which engages the kelly 217 at the upper end of the drill string 212. The drill string 212 is suspended from a hook 218, attached to a traveling block (not shown), through the kelly 217 and a rotary swivel 219 which permits rotation of the drill string 212 relative to the hook 218. As an example, a top drive system may be suitably used.

In the example of FIG. 2, the surface system further includes drilling fluid (e.g., mud, etc.) 226 stored in a pit 227 formed at the wellsite. As an example, a wellbore may be drilled to produce fluid, inject fluid or both (e.g., hydrocarbons, minerals, water, etc.). In the example of FIG. 2, the drill string 212 (e.g., including one or more downhole tools) may be composed of a series of pipes threadably connected together to form a long tube with the drill bit 251 at the lower end thereof. As the drill tool 212 is advanced into a wellbore for drilling, at some point in time prior to or coincident with drilling, the drilling fluid 226 may be pumped by a pump 229 from the pit 227 (e.g., or other source) via a line 232 to a port in the swivel 219 to a passage (e.g., or passages) in the drill string 212 and out of ports located on the drill bit 251 (see, e.g., a directional arrow 208). As the drilling fluid 226 exits the drill string 212 via ports in the drill bit 251, it then circulates upwardly through an annular region between an outer surface(s) of the drill string 212 and surrounding wall(s) (e.g., open borehole, casing, etc.), as indicated by directional arrows 209. In such a manner, the drilling fluid 226 lubricates the drill bit 251 and carries heat energy (e.g., frictional or other energy) and formation cuttings to the surface where the drilling fluid 226 (e.g., and cuttings) may be returned to the pit 227, for example, for recirculation (e.g., with processing to remove cuttings, etc.).

The drilling fluid 226 pumped by the pump 229 into the drill string 212 may, after exiting the drill string 212, form a mudcake that lines the wellbore which, among other functions, may reduce friction between the drill string 212 and surrounding wall(s) (e.g., borehole, casing, etc.). A reduction in friction may facilitate advancing or retracting the drill string 212. During a drilling operation, the entire drill string 212 may be pulled from a wellbore and optionally replaced, for example, with a new or sharpened drill bit, a smaller diameter drill string, etc. The act of pulling a drill string out of a hole or replacing it in a hole is referred to as tripping. A trip may be referred to as an upward trip or an outward trip or as a downward trip or an inward trip depending on trip direction.

As an example, consider a downward trip where upon arrival of the drill bit 251 of the drill string 212 at a bottom of a wellbore, pumping of the drilling fluid 226 commences to lubricate the drill bit 251 for purposes of drilling to enlarge the wellbore. As mentioned, the drilling fluid 226 is pumped by pump 229 into a passage of the drill string 212 and, upon filling of the passage, the drilling fluid 226 may be used as a transmission medium to transmit energy, for example, energy that may encode information as in mud-pulse telemetry.

As an example, mud-pulse telemetry equipment may include a downhole device configured to effect changes in pressure in the drilling fluid 226 to create an acoustic wave or waves upon which information may modulated. In such an example, information from downhole equipment (e.g., one or more modules of the drill string 212) may be transmitted uphole to an uphole device 234, which may relay such information to other equipment 236 for processing, control, etc.

As an example, the drill string 212 may be fitted with telemetry equipment 240 that may include a rotatable drive shaft, a turbine impeller mechanically coupled to the drive shaft such that the drilling fluid 226 can cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the drilling fluid 226, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the drilling fluid 226. In the example of FIG. 2, the uphole device 234 may include circuitry to sense pressure pulses generated by telemetry equipment 240 and, for example, communicate sensed pressure pulses or information derived therefrom to the equipment 236 for process, control, etc.

The bottom hole assembly 250 of the illustrated embodiment includes a logging-while-drilling (LWD) module 252, a measuring-while-drilling (MWD) module 253, an optional module 254, a roto-steerable system and motor 255, and the drill bit 251.

The LWD module 252 may be housed in a suitable type of drill collar and can contain one or a plurality of selected types of logging tools. It will also be understood that more than one LWD and/or MWD module can be employed, for example, as represented at by the module 254 of the drill string 212. Where the position of an LWD module is mentioned, as an example, it may refer to a module at the position of the LWD module 252, the module 254, etc. An LWD module can include capabilities for measuring, processing, and storing information, as well as for communicating with the surface equipment. In the illustrated example embodiment of FIG. 2, the LWD module 252 may include a seismic measuring device.

The MWD module 253 may be housed in a suitable type of drill collar and can contain one or more devices for measuring characteristics of the drill string 212 and drill bit 251. As an example, the MWD tool 253 may include equipment for generating electrical power, for example, to power various components of the drill string 212. As an example, the MWD tool 253 may include the telemetry equipment 240, for example, where the turbine impeller can generate power by flow of the drilling fluid 226; it being understood that other power and/or battery systems may be employed for purposes of powering various components. As an example, the MWD module 253 may include one or more of the following types of measuring devices: a weight-on-bit measuring device, a torque measuring device, a vibration measuring device, a shock measuring device, a stick slip measuring device, a direction measuring device, and an inclination measuring device.

Figure 3:
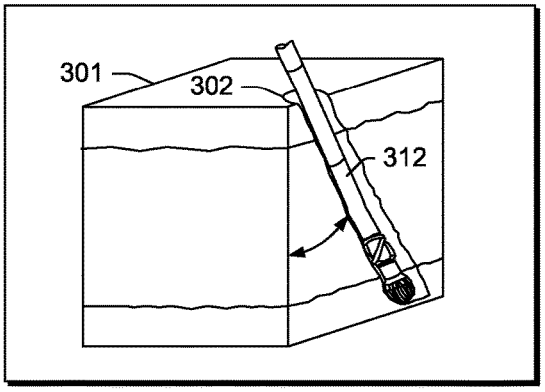
FIG. 3 illustrates examples of equipment with respect to a geologic environment and an example of a method.
Figure 3:
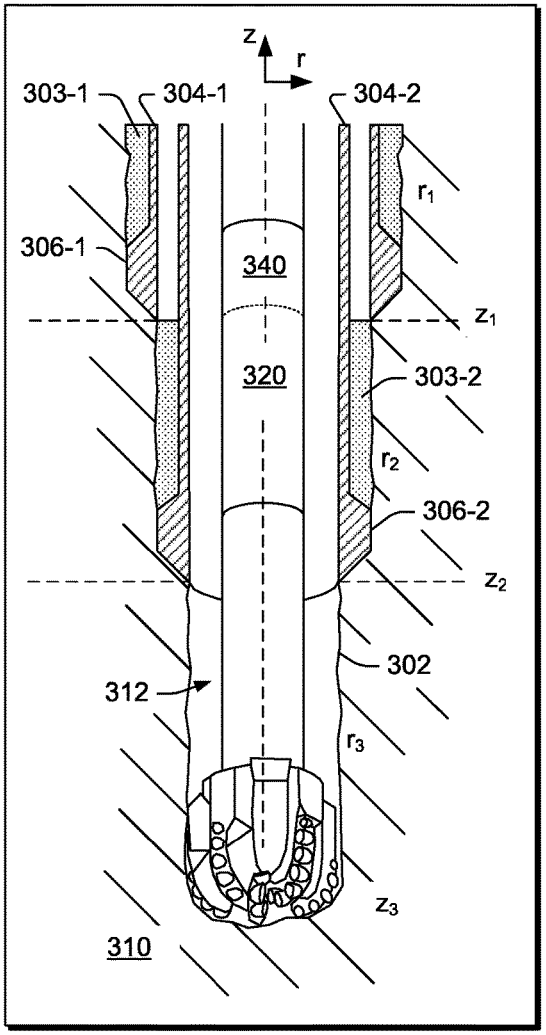
Figure 3:
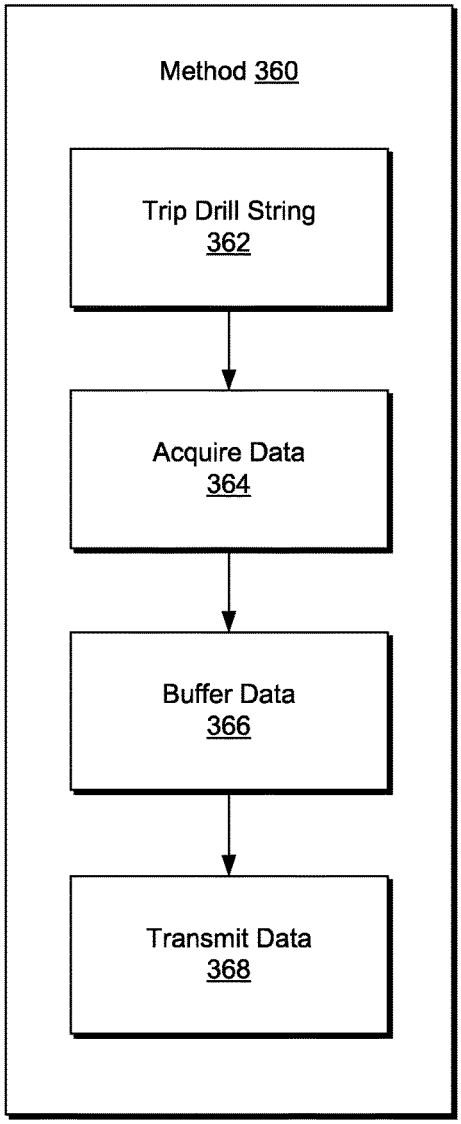
Figure 3:
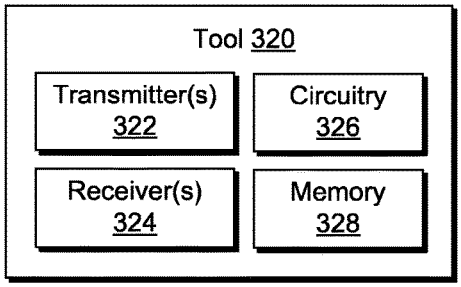

FIG. 3 illustrates an example of a system 310 that includes a drill string 312 with a tool (or module) 320 and telemetry equipment 340 (e.g., which may be part of the tool 320 or another tool) and an example of a method 360 that may be implemented using the system 310. In the example of FIG. 3, the system 310 is illustrated with respect to a wellbore 302 (e.g., a borehole) in a portion of a subterranean formation 301 (e.g., a sedimentary basin). The wellbore 302 may be defined in part by an angle (Θ); noting that while the wellbore 302 is shown as being deviated, it may be vertical (e.g., or include one or more vertical sections along with one or more deviated sections, which may be, for example, lateral, horizontal, etc.).

As shown in an enlarged view with respect to an r, z coordinate system (e.g., a cylindrical coordinate system), a portion of the wellbore 302 includes casings 304-1 and 304-2 having casing shoes 306-1 and 306-2. As shown, cement annuli 303-1 and 303-2 are disposed between the wellbore 302 and the casings 304-1 and 304-2. Cement such as the cement annuli 303-1 and 303-2 can support and protect casings such as the casings 304-1 and 304-2 and when cement is disposed throughout various portions of a wellbore such as the wellbore 302, cement can help achieve zonal isolation.

In the example of FIG. 3, the wellbore 302 has been drilled in sections or segments beginning with a large diameter section (see, e.g., $r_1$) followed by an intermediate diameter section (see, e.g., $r_2$) and a smaller diameter section (see, e.g., $r_3$). As an example, a large diameter section may be a surface casing section, which may be three or more feet in diameter and extend down several hundred feet to several thousand feet. A surface casing section may aim to prevent washout of loose unconsolidated formations. As to an intermediate casing section, it may aim to isolate and protect high pressure zones, guard against lost circulation zones, etc. As an example, intermediate casing may be set at about X thousand feet and extend lower with one or more intermediate casing portions of decreasing diameter (e.g., in a range from about thirteen to about five inches in diameter). A so-called production casing section may extend below an intermediate casing section and, upon completion, be the longest running section within a wellbore (e.g., a production casing section may be thousands of feet in length). As an example, production casing may be located in a target zone where the casing is perforated for flow of fluid into a lumen of the casing.

Referring again to the tool 320 of FIG. 3, it may carry one or more transmitters 322 and one or more receivers 324. In the example of FIG. 3, the tool 320 includes circuitry 326 and a memory device 328 with memory for storage of data (e.g., information), for example, signals sensed by one or more receivers 324 and processed by the circuitry 326 of the tool 320. As an example, the tool 320 may buffer data to the memory device 328. As an example, data buffered in the memory device 328 may be read from the memory device 328 and transmitted to a remote device using a telemetry technique (e.g., wired, wireless, etc.).

Figure 4:
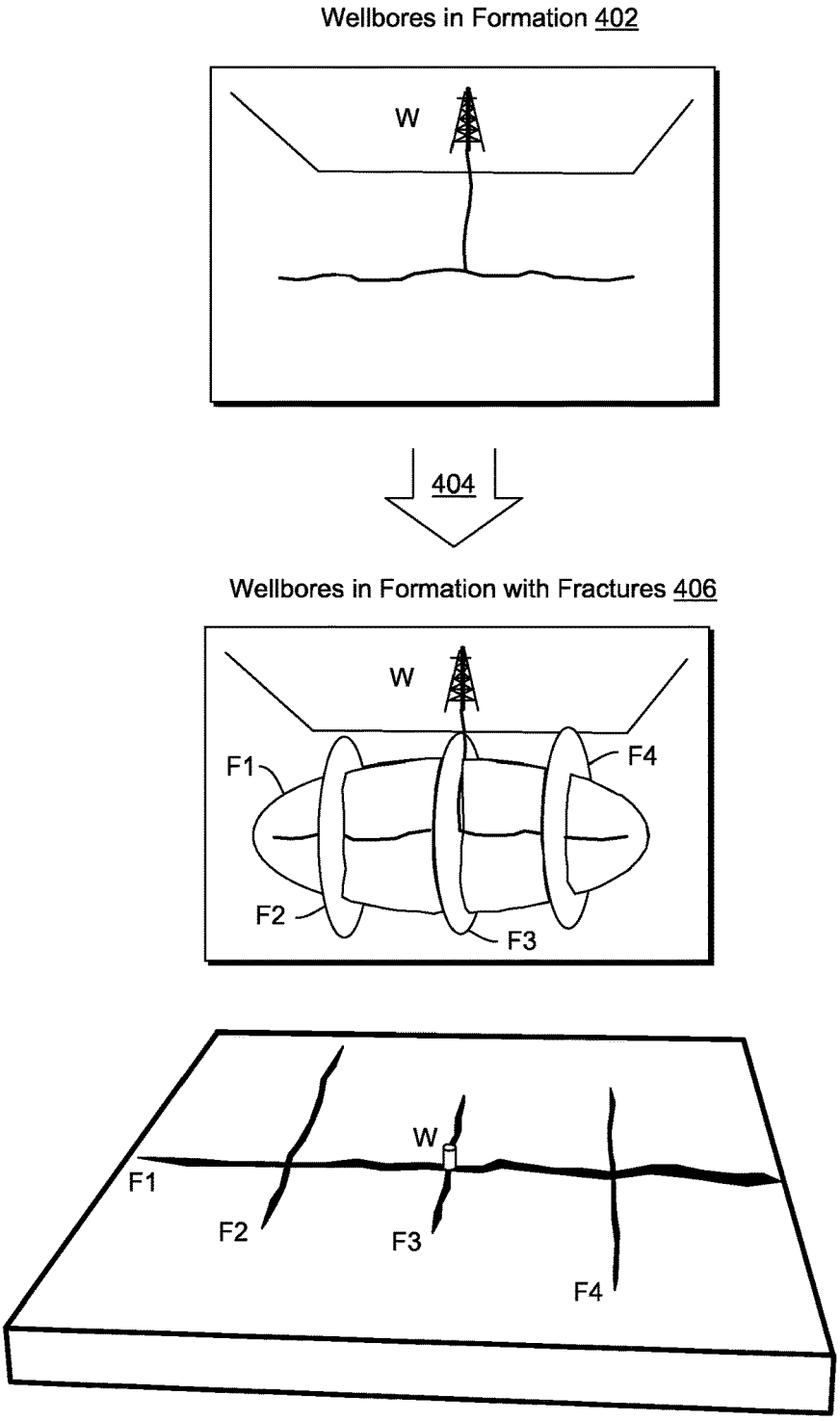
FIG. 4 illustrates an example of a well in a formation and an example of a well in a fractured formation.

FIG. 4 shows an example of a well with wellbores in a formation 402 (e.g., bores in a geologic environment) and an example of a well with wellbores in a formation and with fractures in the formation 406, for example, as generated by a stimulation technique 404 (e.g., hydraulic fracturing). The stimulation technique 404 may be considered a treatment technique, for example, a fracturing technique (e.g., hydraulic fracturing, etc.).

Figure 5:
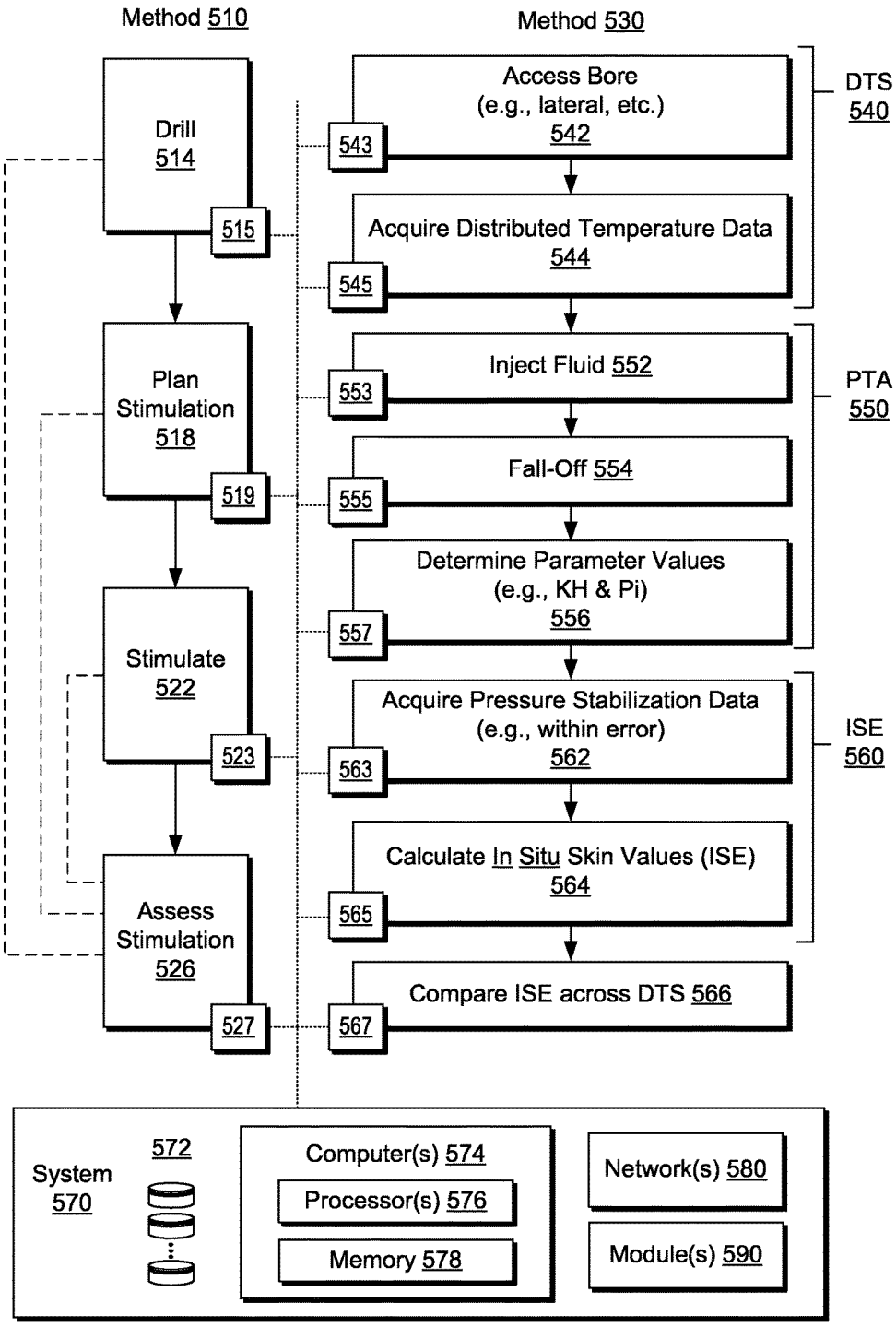
FIG. 5 illustrates examples of methods and an example of a system.

FIG. 5 shows an example of a method 510, an example of a method 530 and an example of a system 570. As shown, the method 510 includes a drill block 514 for drilling a bore in a geologic environment, a plan block 518 for planning stimulation (e.g., a stimulation treatment), a stimulation block 522 for performing stimulation and an assessment block 526 for assessing stimulation, for example, as performed per the stimulation block 522. As indicated by dashed lines, the method 510 may include one or more loops, for example, where one or more actions occur based at least in part on a stimulation assessment.

As an example, the method 510 may be implemented to form one or more bores (see, e.g., the environment 402 of FIG. 4) and to form one or more fractures (see, e.g., the environment 406 of FIG. 4). As an example, the method 510 may implement, at least in part, a stimulation technique (see, e.g., the stimulation technique 404 of FIG. 4).

In FIG. 5, the method 530 can provide for characterizing one or more bores, for example, before a treatment, after a treatment, etc. As shown, the method 530 includes an access block 542 for accessing a bore (e.g., a lateral bore, etc.), an acquisition block 544 for acquiring distributed temperature data in at least a portion of the bore (e.g., a distributed temperature survey (DTS)), an injection block 552 for injecting fluid in at least a portion of the bore, a fall-off block 554 for providing a fall-off period for injected fluid (e.g., a fall-off window of time, etc.), a determination block 556 for determining one or more parameter values based at least in part on the fluid injection of the injection block 552, an acquisition block 562 for acquiring pressure stabilization data (e.g., for a pressure stabilization period within one or more error criteria) to determine one or more pressure stabilization related values, a calculation block 564 for calculating one or more in situ skin values (e.g., in situ skin evaluation (ISE) values), and an optional comparison block 566 for comparing the in situ skin values (e.g., ISE values) to the temperature data (e.g., DTS values), for example, via plotting and rendering at least one plot to a display, a printer, etc. As an example, the method 530 may include a block for storing, transmitting, rendering, etc. the one or more calculated ISE values of the calculation block 565.

As an example, one or more portions of the method 530 may optionally be implemented in conjunction with one or more portions of the method 510. As an example, the method 530 may include a distributed temperature survey (DTS) phase 540, a pressure transient analysis (PTA) phase 550 and an ISE phase 560. For example, the DTS phase 540 can include acquiring and/or receiving DTS values, the PTA phase 550 can include acquiring, calculating and/or receiving one or more parameter values based at least in part on flow of fluid in a bore, and the ISE phase 560 can include calculating at least one in situ skin value based at least in part on at least one of the one or more parameter values of the PTA phase 550.

As an example, the ISE phase 560 can include acquiring and/or receiving one or more values associated with pressure stabilization (e.g., at one or more locations) and, for example, calculating one or more ISE values based at least in part on thereon. As an example, a value associated with pressure stabilization may be a stable flowing pressure at a particular location (e.g., P1(x1), P1(x2), etc.). As an example, an ISE value (e.g., S1 at x1, S2 at x2, etc.) may be based at least in part on a stable flowing pressure. As an example, the ISE phase 560 can include storing, transmitting, etc., one or more pressure stabilization values and/or one or more ISE values to one or more blocks of the method 510. For example, drilling per the drill block 514 may be performed based at least in part on one or more ISE values, planning per the plan block 518 may be performed based at least in part on one or more ISE values, stimulation per the stimulation block 522 may be performed based at least in part on one or more ISE values and/or assessing per the assessment block 526 may be performed based at least in part on one or more ISE values.

As an example, a method can include performing the PTA phase 550 and the ISE phase 560, for example, optionally without performing the DTS phase 540 (e.g., without acquiring and/or receiving DTS data).

As an example, the PTA phase 550 may include performing at least a portion of an injectivity test or injection test. An injectivity test or injection test may aim to establish rates and pressures at which fluids can be pumped into a treatment target within a formation, for example, without fracturing the formation. As an example, the PTA phase 550 can include determining one or more formation related parameter values such as, for example, one or more formation capacity values (KH) values and one or more average reservoir pressure values (Pi).

In the example of FIG. 5, the system 570 includes one or more information storage devices 572, one or more computers 574, one or more networks 580 and one or more modules 590. As to the one or more computers 574, each computer may include one or more processors (e.g., or processing cores) 576 and memory 578 for storing instructions (e.g., modules), for example, executable by at least one of the one or more processors. As an example, a computer may include one or more network interfaces (e.g., wired or wireless), one or more graphics cards, a display interface (e.g., wired or wireless), etc.

As an example, a method may be implemented in part using computer-readable media (CRM), for example, as a module, a block, etc. that includes information such as instructions suitable for execution by one or more processors (or processor cores) to instruct a computing device or system to perform one or more actions. As an example, a single medium may be configured with instructions to allow for, at least in part, performance of various actions of a method. As an example, a computer-readable medium (CRM) may be a computer-readable storage medium (e.g., a non-transitory medium that is not a carrier wave). In FIG. 5, various blocks 515, 519, 523, 527, 543, 545, 553, 555, 557, 563, 565 and 567 are illustrated as optionally being part of the system 570. For example, such blocks may be modules of the one or more modules 590 and, for example, include information such as instructions suitable for execution by one or more of the one or more processors 576. As an example, such blocks may optionally be stored in the one or more information storage devices 572, in the memory 578, etc. As an example, such blocks may be in the form of computer-readable media, that are non-transitory and not carrier waves.

As an example, the PTA phase 550 may be considered to be an assessment phase that assesses at least a portion of a formation. As an example, an assessment may be considered to be a test. As an example, a test may involve injection of fluid into a bore in a formation where a portion of that fluid may flow into the formation, optionally filling a fracture, optionally generating a fracture, etc. As an example, a fluid may be a gas, a liquid or multi-phase. As an example, an assessment may include a fall-off test, for example, in which injection may be halted after a delivery period and pressure decline measured as a function of time. As an example, an assessment may include a build-up test. As an example, an assessment may include a drawdown test.

As an example, a drawdown test may include measurement and analysis of pressure data taken after a well is put on production (e.g., initially, following a shut-in period, etc.). Drawdown data tend to include noise due to pressure moving up and down, which may obscure regions of interest. As an example, transient downhole flow rates measured while flowing may be used to adjust for pressure variations through convolution or deconvolution calculations that enable diagnosis and interpretation, analogous to that done for the pressure change and derivative.

As an example, a build-up test may include measurement and analysis of pressure data (e.g., bottomhole, etc.) acquired after a producing well is shut in. Build-up tests may help to determine well flow capacity, permeability thickness, skin effect and other information.

As an example, the ISE phase 560 may be considered to be an assessment phase. In such an example, the ISE phase 560 can include flowing fluid while monitoring pressure and measuring a stabilization pressure, for example, where pressure stabilizes with respect to time (e.g., where measured pressure plateaus, reaches a relatively constant value with respect to time, etc.).

As an example, one of the one or more modules 590 may include instructions for performing an in situ assessment of stimulation, for example, optionally while performing stimulation.

As an example, a method may be implemented in a portion of a bore that does not include casing (e.g., "open-hole"). As an example, such a portion may be deviated, for example, lateral, non-vertical, horizontal, etc. As an example, the bore may be a bore of a producer well or a bore of an injector well.

As an example, a tool may be a conveyance tool that, for example, allows fluid to be pumped into portions of a formation (e.g., optionally continuously). As an example, a tool may include tubing (e.g., coil tubing, etc.). As an example, a tool may include a pressure sensor (e.g., a pressure gauge).

As an example, a system may include depth control equipment for positioning of a tool. As an example, such a system may include mechanical and/or optical components that may provide information, control, etc. for purposes of depth, distance, etc. of a pressure sensor, a fluid orifice, etc. As an example, a system may include a pump operatively coupled to a tool, for example, to pump fluid via tubing at a sufficient rate and pressure to be detectable downhole by one or more pressure sensors (e.g., of the tool).

As an example, a method may include running in hole (e.g., in a bore) with a tool equipped with at least one pressure gauge where the tool is operatively coupled to depth/distance control equipment (e.g., at surface, etc.). In such an example, a maximum depth/distance (D max) may be reached, which may be, for example, a terminal depth (TD) or a lockup depth. In such an example, the tool may be maintained at a particular position (e.g., D max) for a period of time. As an example, a tool may be repositioned, for example, at one or more positions in a bore.

As an example, a method may include implementing one or more equations such as, for example, a skin factor value equation that may be associated with a particular direction of fluid flow (e.g., or pressure differential, etc.). For example, consider the following equation (Eq. 1.1):

$$S_1 = \frac{KH}{141.2\ Q_2\beta_w\mu_w}\Delta P_S$$

where $\Delta P_S = P_1 - P_i$.

In Eq. 1.1:

$S_1$: Skin at $x_1$

KH: Formation capacity (e.g., mD·ft)

$Q_2$: Injection rate (e.g., STB/day)

$\beta_w$: Formation volume factor for injected water (e.g., BBL/STB)

$\mu_w$: Injected water viscosity at formation temperature (e.g., cP)

$P_1$: Stable injection pressure at x1 (e.g., psi)

$P_i$: Average formation (reservoir) pressure (e.g., psi)

As an example, a method may include implementing one or more equations such as, for example, a skin factor value equation that may be associated with a particular direction of fluid flow (e.g., or pressure differential, etc.). For example, consider the following equation (Eq. 1.2):

$$S_1 = \frac{KH}{141.2\ Q_2\beta_f\mu_f}\Delta P_S$$

where $\Delta P_S = P_i - P_1$.

In Eq. 1.2:

$S_1$: Skin at $x_1$

KH: Formation capacity (e.g., mD·ft)

$Q_2$: Flowing rate (e.g., STB/day)

$\beta_f$: Formation volume factor for flowing fluid (e.g., BBL/STB)

$\mu_f$: Flowing fluid viscosity at formation temperature (e.g., cP)

$P_1$: Stable flowing pressure at x1 (e.g., psi)

$P_i$: Average formation (reservoir) pressure (e.g., psi)

Figure 6:
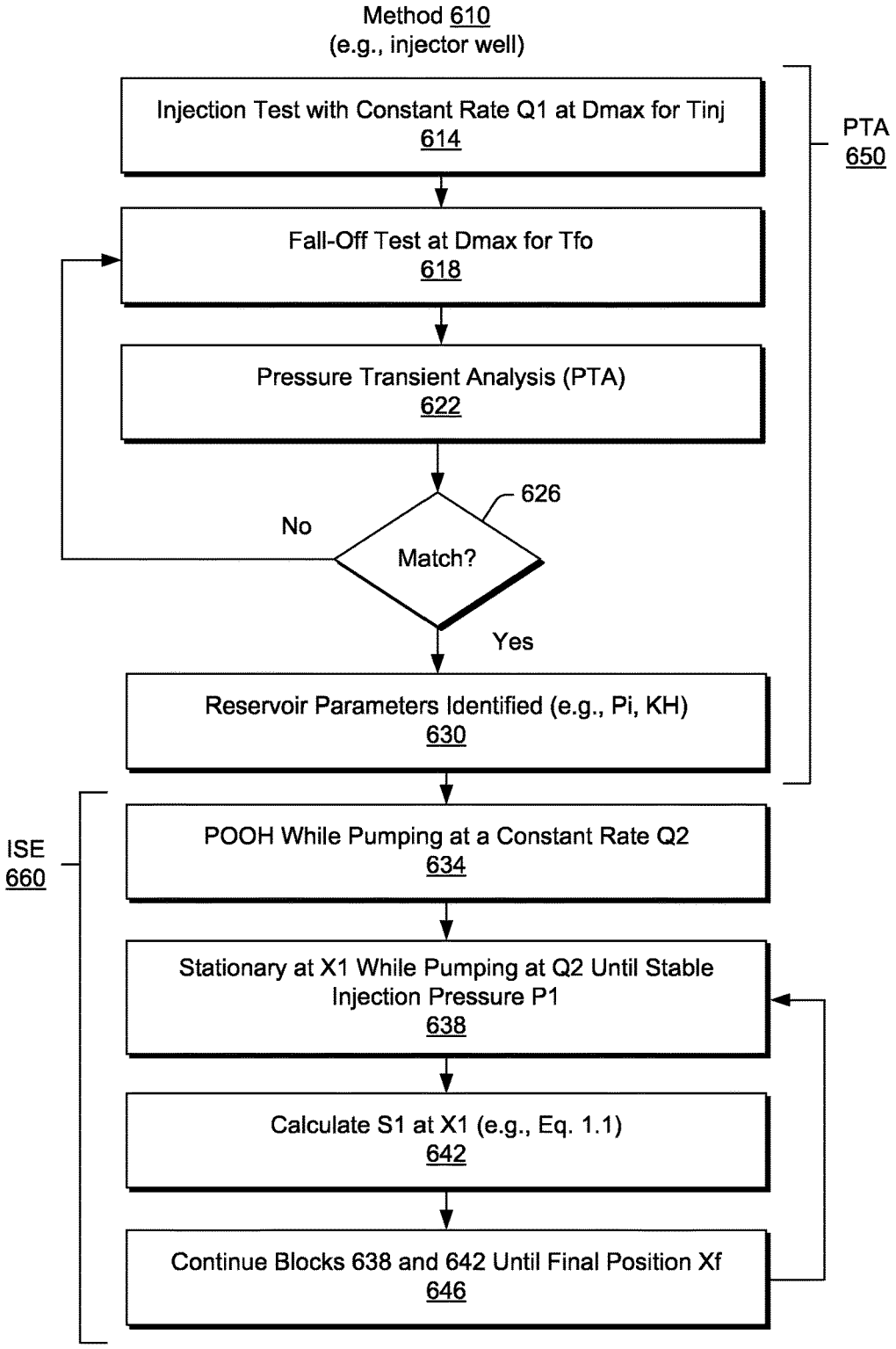
FIG. 6 illustrates an example of a method.

FIG. 6 shows an example of a method 610, which may pertain to an injector well. As shown, the method 610 includes an injection test block 614 for an injection test with an approximately constant rate Q1 at D max for Tinj, a fall-off test block 618 for a fall-off test at D max for Tfo, a pressure transient analysis (PTA) block 622 for performing a PTA analysis, a decision block 626 for deciding if results from the PTA analysis match a model, an identification block 630 for identifying one or more reservoir (e.g., formation) parameters, a "pulling out of hole" (POOH) block 634 while pumping at an approximately constant rate Q2, a stationary block 638 for maintaining a tool stationary at a position X1 until a stable injection pressure P1 is measured (e.g., according to a stability criterion, etc.), a calculation block 642 for calculating S1 at the position X1 (see, e.g., Eq. 1.1) and a continuation block 646 for continuing to perform actions of blocks 638 and 642, for example, at different positions until a final position Xf. As indicated, if the decision block 626 decides that a match does not exist (e.g., according to one or more match criteria, etc.), the method 610 may continue at the fall-off test block 618 (e.g., optionally to allow for more time).

As indicated in FIG. 6, the method 610 can include a PTA phase 650 and an ISE phase 660. The PTA phase 650 can include determining one or more formation parameter values (e.g., Pi, KH) and the ISE phase 660 can include determining one or more skin values (e.g., S).

Figure 7:
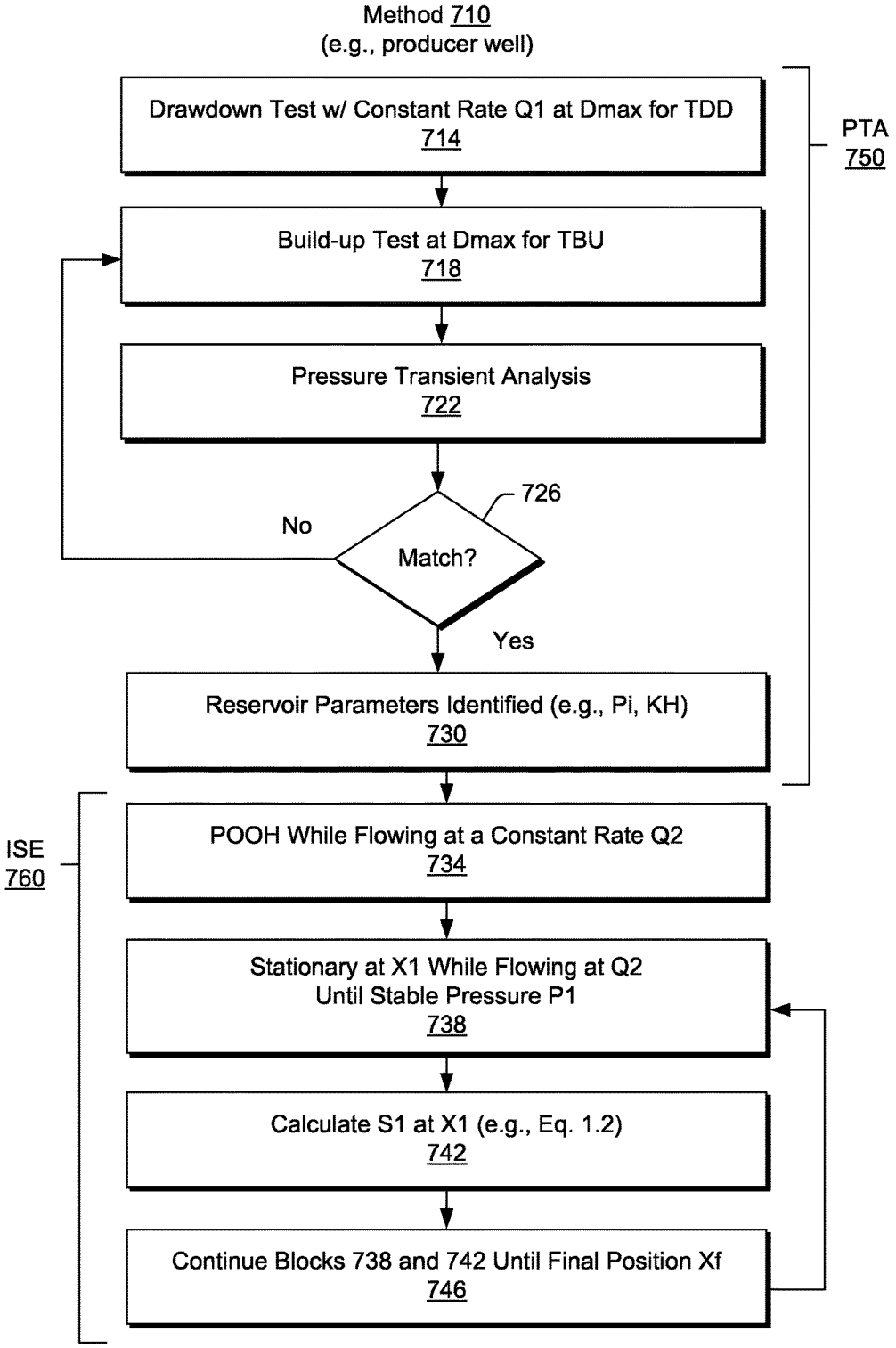
FIG. 7 illustrates an example of a method.

FIG. 7 shows an example of a method 710, which may pertain to a producer well. As shown, the method 710 includes a drawdown test block 714 for a drawdown test with an approximately constant rate Q1 at D max for TDD, a build-up test block 718 for a build-up test at D max for TBU, a pressure transient analysis (PTA) block 722 for performing a PTA analysis, a decision block 726 for deciding if results from the PTA analysis match a model, an identification block 730 for identifying one or more reservoir (e.g., formation) parameters, a "pulling out of hole" (POOH) block 734 while flowing at an approximately constant rate Q2, a stationary block 738 for maintaining a tool stationary at a position X1 while flowing fluid until a stable pressure P1 is measured (e.g., according to a stability criterion, etc.), a calculation block 742 for calculating S1 at the position X1 (see, e.g., Eq. 1.2) and a continuation block 746 for continuing to perform actions of blocks 738 and 742, for example, at different positions until a final position Xf. As indicated, if the decision block 726 decides that a match does not exist (e.g., according to one or more match criteria, etc.), the method 710 may continue at the build-up test block 718 (e.g., optionally to allow for more time).

As indicated in FIG. 7, the method 710 can include a PTA phase 750 and an ISE phase 760. The PTA phase 750 can include determining one or more formation parameter values (e.g., Pi, KH) and the ISE phase 760 can include determining one or more skin values (e.g., S).

As an example, one or more stable pressure criteria may depend on a pressure gauge resolution (e.g., ~0.1 psi/min, etc.). In the aforementioned methods 610 and 710, D max may be a maximum reachable depth inside a lateral (e.g., horizontal, etc.) section (e.g., TD or lockup depth); Tinj may be an injection time (e.g., equal to lateral openhole volume*(1/injection rate through coil tubing)*2.5); Tfo may be a fall-off time (e.g., equal to 1.5*Tinj); TDD may be a drawdown time (e.g., equal to lateral openhole volume*(1/drawdown rate)*2.5); TBU may be a build-up time (e.g., equal to 1.5*TBU); Pi may be an average reservoir pressure (e.g., psi, etc.); KH may be a formation capacity (e.g., mD·ft, etc.); Sx may be a skin factor value at a distance/depth Xn (e.g., S1@X1=xxx ft·MD, etc.); Xf may be a last desired depth/distance of a horizontal section, a lateral window, etc. As an example, an interval as to depth/distance may be in a range from approximately 20 ft to approximately 50 ft (e.g., approximately 6 meters to approximately 15 meters).

As an example, a method may be implemented to evaluate stimulation performance, for example, by comparing "ISE" metrics before and after a stimulation treatment. As an example, such a method may be optionally implemented in real-time, for example, to reduce the amount of time to flowback a well to evaluate job performance. Such an approach may, for example, be helpful where a treated well is set to treated and to remain closed for a period of time.

As an example, a method (e.g., a workflow, etc.) may include optimization of a well testing program. For example, such a method may include receiving or determining information from an ISE (e.g., an in situ measure-based PTA analysis for one or more laterals).

As an example, a method may include analyzing skin evolution with respect to time (e.g., based at least in part on skin factor values, etc.). For example, consider monitoring skin evolution at a cycle of time where such information may help one to understand reservoir complexity and reduce at least a portion of uncertainty related to one or more causes for formation damage.

As an example, a method may include implementing an ISE approach for lateral profiling. For example, ISE information may provide a parameter representative of a lateral (e.g., at a point of time). As an example, ISE information may be a "fingerprint" for at least a portion of a bore. As an example, ISE information may be presented for different times to illustrate evolution with respect to time (e.g., as a series of fingerprints). As an example, a bore with multiple laterals may be fingerprinted where, for example, individual laterals may be characterized at least in part by their respective fingerprints (e.g., skin factor values with respect to a spatial dimension, optionally with respect to a time dimension).

Figure 8:
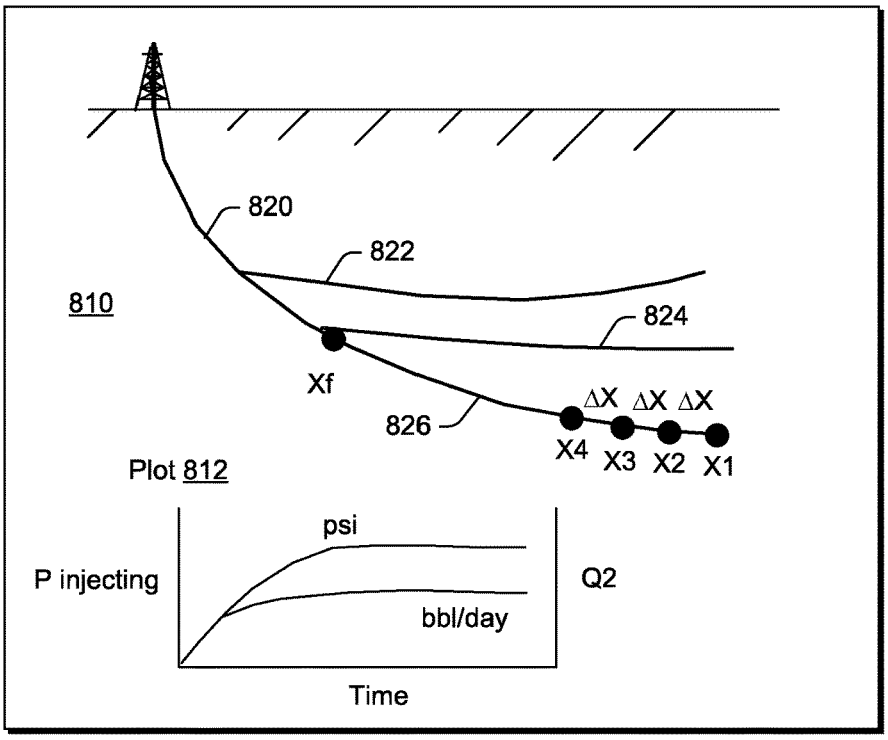
FIG. 8 illustrate an example of an injector scenario and an example of a producer scenario.
Figure 8:
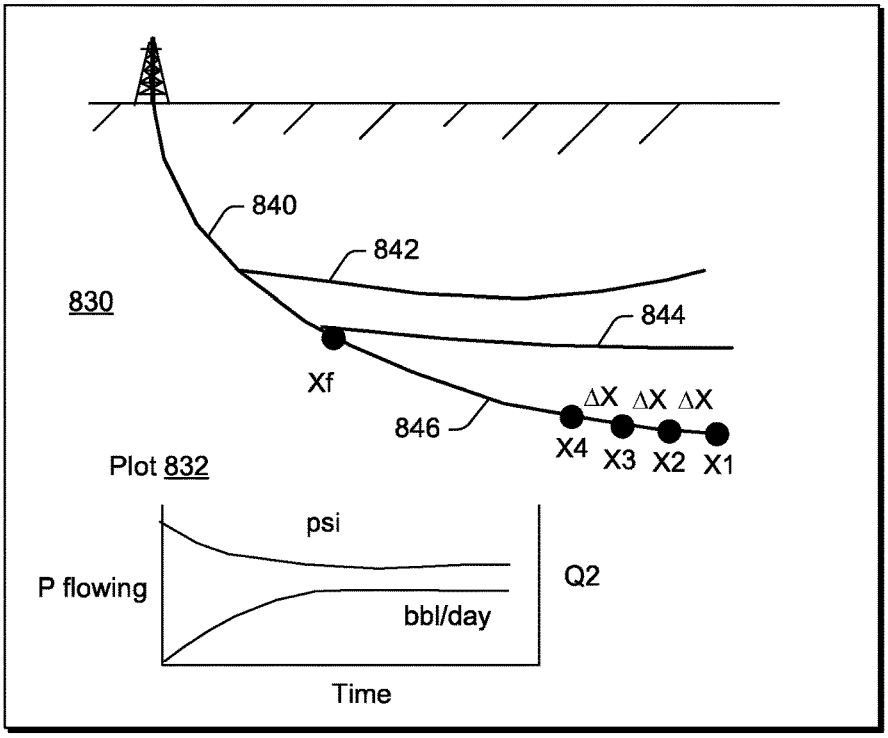

FIG. 8 shows an example of an injector scenario 810 and an example of a producer scenario 830. In these examples, various laterals are shown as being formed off a main bore (see, e.g., a bore 820 with laterals 822, 824 and 826 and a bore 840 with laterals 842, 844 and 846). As an example, a method may be implemented for evaluating skin in one or more of the laterals of the scenario 810 and/or the scenario 830. Such a method may include advancing and/or retracting a tool while the method includes delivering stimulation (e.g., optionally via the tool, in part via the tool, etc.). For example, consider the various positions X1, X2, to Xf in the lateral bore 826 of the scenario 810 and/or the various positions X1, X2 to Xf in the lateral bore 846 of the scenario 830. As an example, information may be acquired as indicated in approximate example plots 812 of the scenario 810 and 832 of the scenario 830.

Figure 9:
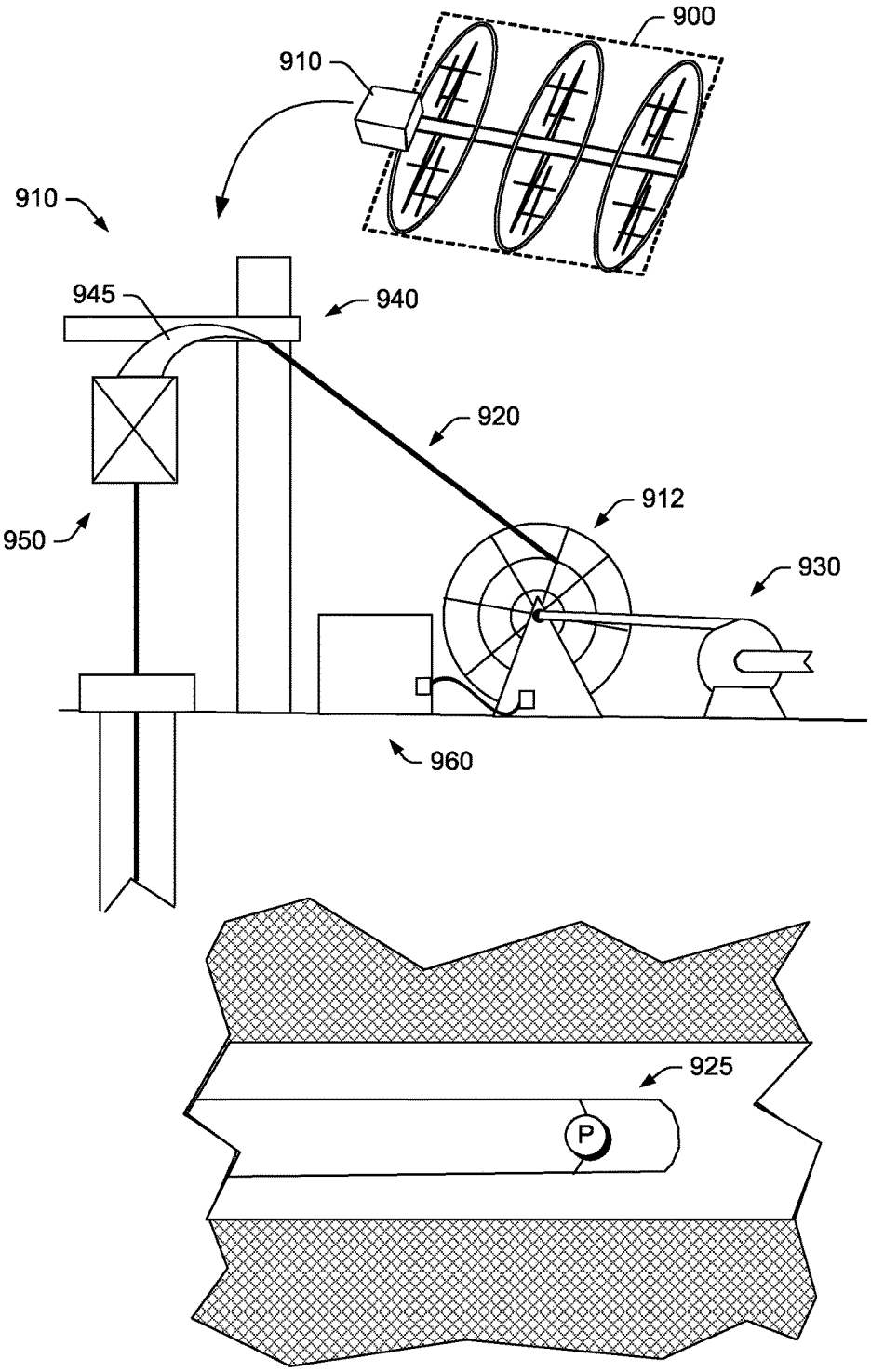
FIG. 9 illustrates an example of a geologic environment, an example of a system and an example of a tool.

FIG. 9 shows an example of a geologic environment 900 and a system 910 positioned with respect to the geologic environment 900. As shown, the geologic environment 900 may include at least one bore and may include one or more fractures, for example, generated via stimulation (e.g., fracturing). As an example, the geologic environment 900 may include a drainage area where fluid in the environment 900 may drain into one or more bores (e.g., optionally at least in part via one or more fractures, etc.). In the example of FIG. 9, the system 910 may include a reel for deploying coil tubing that is operatively coupled to a tool 925 that includes at least one pressure sensor. As an example, the system 910 may include a rig 940 that carries a coil tubing mechanism such as a gooseneck 945 and a coil tubing box 950 that may function to transition coil tubing from a reel to a downward direction for positioning in a bore.

As an example, the system 910 may include a pump 930, which may operate to pump fluid (e.g., in one or more directions). As an example, the pump 930 may be operatively coupled to the coil tubing 920 for purposes of pumping fluid into or out of the coil tubing 920.

As an example, the coil tubing 920 may include one or more wires, for example, to carry power, signals, etc. For example, one or more wires may operatively couple to the tool 925 for purposes of powering a sensor, receiving information from a sensor, etc. As shown in the example of FIG. 9, a unit 960 may include circuitry that is electrically coupled (e.g., via wire or wirelessly) to the tool 925, for example, via a deployment mechanism. As an example, the coil tubing 920 may include or carry one or more wires and/or other communication equipment (e.g., fiber optics, rely circuitry, wireless circuitry, etc.) that are operatively coupled to the tool 925. As an example, the unit 960 may process information acquired by the tool 925. As an example, the unit 960 may include one or more controllers for controlling, for example, operation of one or more components of the system 910 (e.g., the reel 912, the pump 930, etc.). As an example, the unit 960 may include circuitry to control depth/distance of deployment of the tool 925. As an example, the unit 960 may include circuitry, modules, etc. for implementation, at least in part, of one or more of the methods of FIG. 5, FIG. 6 and FIG. 7.

As an example, the system 910 may be configured to perform at least part of a stimulation process. For example, the system 910 may be configured to perform pumping fluid for purposes of hydraulic fracturing. As an example, the system 910 may be configured to pump water and/or other material (e.g., proppant, surfactants, etc.), optionally via tubing. As an example, a system may include additional equipment for purposes of performing stimulation. As an example, such equipment may be optionally utilized simultaneously with a tool that can sense pressure in a lateral bore in a geologic formation.

As mentioned, a method may include acquiring and/or receiving temperature data where such data may be in the form of a distributed temperature survey (DTS). As an example, such data may be compared to information of a pressure transient analysis (PTA).

Figure 10:
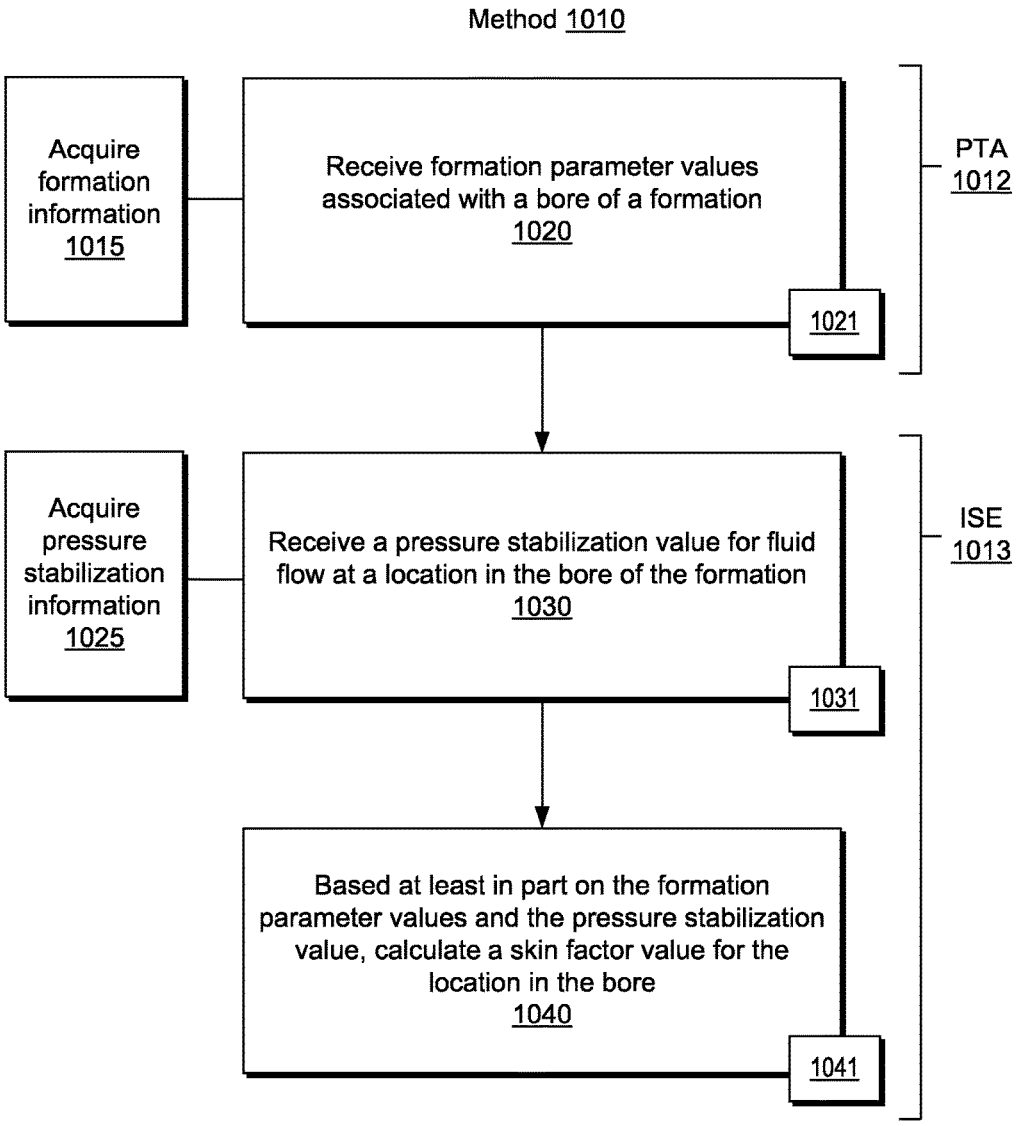
FIG. 10 illustrates an example of a method.

FIG. 10 shows an example of a method 1010 that includes a reception block 1020 for receiving formation parameter values associated with a bore of a formation; a reception block 1030 for receiving a pressure stabilization value for fluid flow at a location in the bore of the formation; and a calculation block 1040 for, based at least in part on the formation parameter values and the pressure stabilization value, calculating a skin factor value for the location in the bore. As an example, the skin factor value may be an in situ evaluation value (e.g., an ISE value).

As an example, the method 1010 may include a PTA phase 1012 and an ISE phase 1013. For example, the PTA phase 1012 can include performing at least part of a pressure transient analysis (PTA) of at least a portion of a formation and the ISE phase 1013 can include performing at least part of an in situ evaluation of at least a portion of a bore in the formation.

FIG. 10 also shows an example of an acquisition block 1015 for acquiring formation information and an acquisition block 1025 for acquiring pressure stabilization information. As an example, the acquisition block 1015 may include performing an injection test (e.g., or injectivity test) and a fall-off test and/or performing a drawdown test and a build-up test. As an example, the acquisition block 1025 may include performing an in-bore process that includes flowing fluid in at least a portion of a bore until measured pressure reaches a relatively constant value, which may be deemed a "stable pressure" (e.g., a pressure stabilization value).

As an example, the method 1010 may include comparing the calculated skin factor value to one or more temperature values, for example, as part of a distributed temperature survey (DTS). For example, a DTS phase may include acquiring a DTS (e.g., DTS data) as part of a workflow that may include the method 1010, a portion of the method 1010, etc.

In FIG. 10, various blocks 1021, 1031 and 1041 are illustrated as optionally being part of a system such as, for example, the system 570 of FIG. 5. Such blocks may be modules of the one or more modules 590 and, for example, include information such as instructions suitable for execution by one or more of the one or more processors 576. As an example, such blocks may optionally be stored in the one or more information storage devices 572, in the memory 578, etc. As an example, such blocks may be in the form of computer-readable media, that are non-transitory and not carrier waves.

Figure 11:
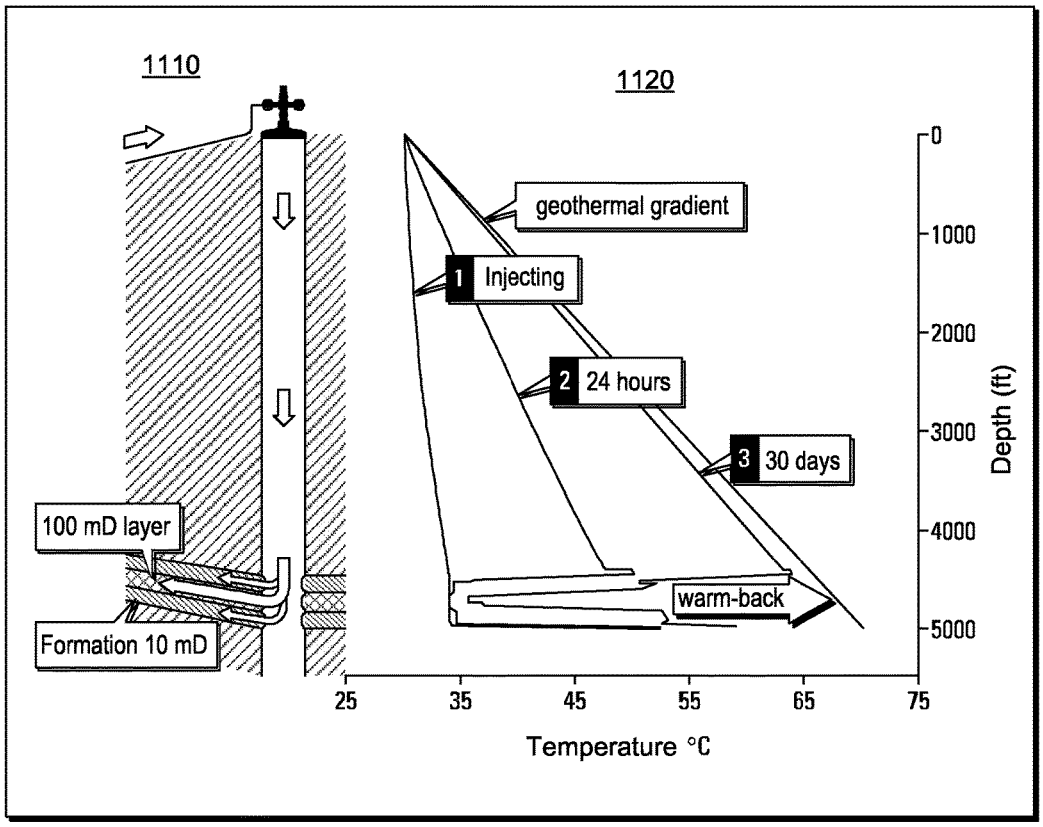
FIG. 11 illustrates an example of a scenario that includes a plot of temperature with respect to depth for a bore.

FIG. 11 shows an example of a scenario 1100 that is illustrated via a graphic of a bore within a formation 1110 and a plot 1120 of temperature data versus a spatial dimension (e.g. depth). In the scenario 1100, fluid is injected into the bore of the formation for a period of time, which may be, for example, of the order of days. During injection, the temperature of the bore (e.g., and sensor(s)) may be expected to be approximately that of the fluid being injected (e.g., as provided at the surface). Once injection is halted, heat from within the formation can warm regions of the bore and formation that were cooled by the injection fluid. As an example, for regions where little injection fluid has entered the formation, that amount of injection fluid may rise in temperature within a period of time of the order of hours (see, e.g., the 24 hour temperature profile); however, where larger amounts of injection fluid enter the formation (see, e.g., depths of about 4500 ft (about 1370 m) to about 5000 ft (about 1525 m)), temperature may rise more slowly, in a more extended period of time back toward the geothermal gradient (e.g., baseline temperature profile). The graphic 1110 shows a 100 mD layer and surrounding formation at 10 mD. In the plot 1120, the higher permeability 100 mD layer may take up an amount of injection fluid such that a temperature increase may occur more slowly compared to the surrounding formation at 10 mD, for example, even at 30 days, the temperature at the 100 mD layer remains close to that of the injection fluid.

Figure 12:
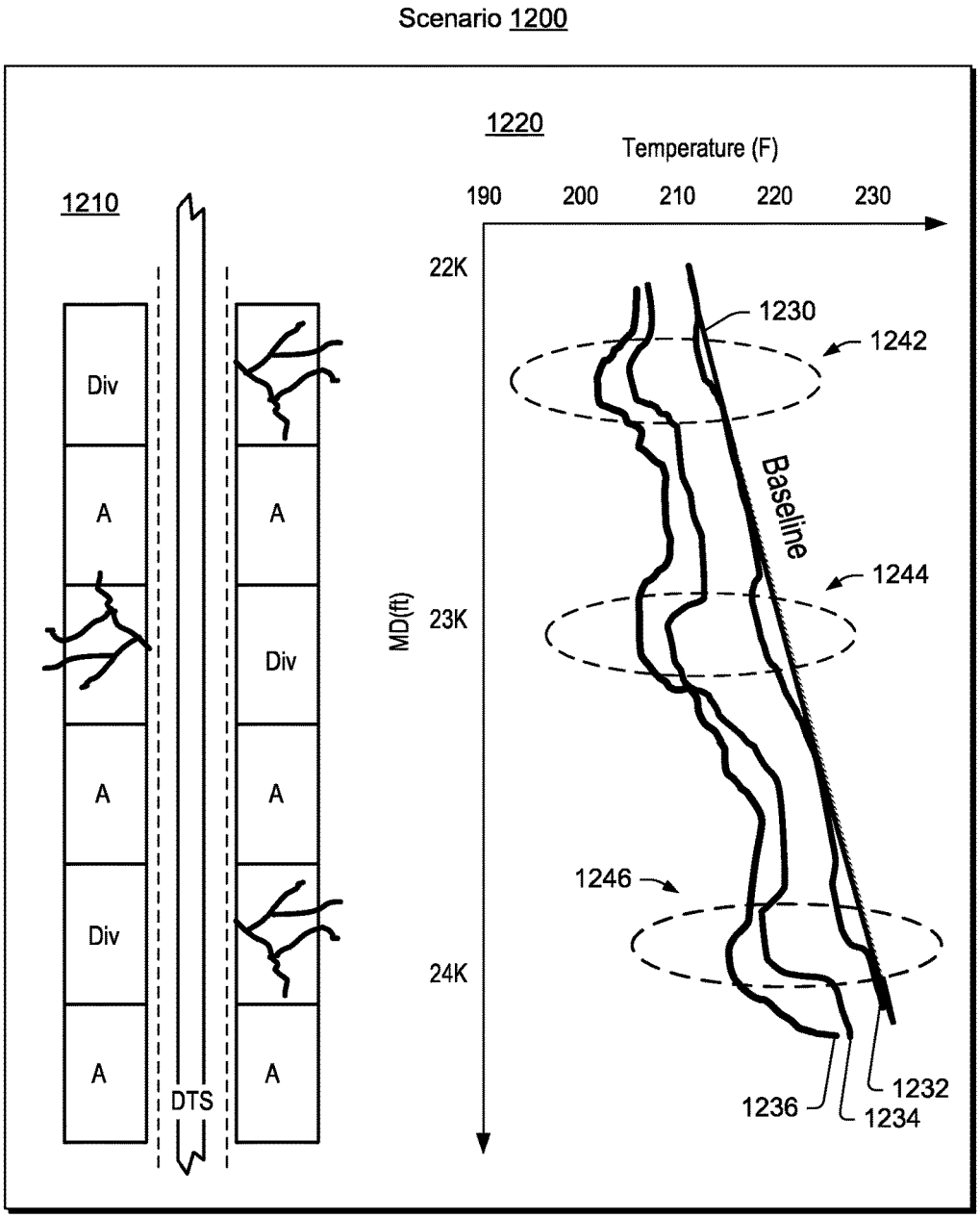
FIG. 12 illustrates an example of a scenario that includes a plot of temperature with respect to depth for a bore.

FIG. 12 shows an example of a scenario 1200 that is illustrated via a graphic of a bore within a formation 1210 and a plot 1220 of temperature data versus a spatial dimension (e.g., depth). As shown, a DTS may be acquired for at least a portion of the bore, which, as shown in the plot 1220, may span over a thousand feet (e.g., over approximately 300 meters). In the plot 1220, a baseline temperature profile characterizes the geothermal effect of the formation while additional temperature profiles 1232, 1234 and 1236 provide information as to injection and warm-back. As indicated, the temperature profiles 1232, 1234 and 1236 include deviations 1242, 1244 and 1246 toward lower temperatures that correspond to regions of the formation that have taken up more injection fluid. Such regions may be of particular interest and help to characterize one or more zones in the formation (e.g., high intake zones, low intake zones, etc.).

Figure 13:
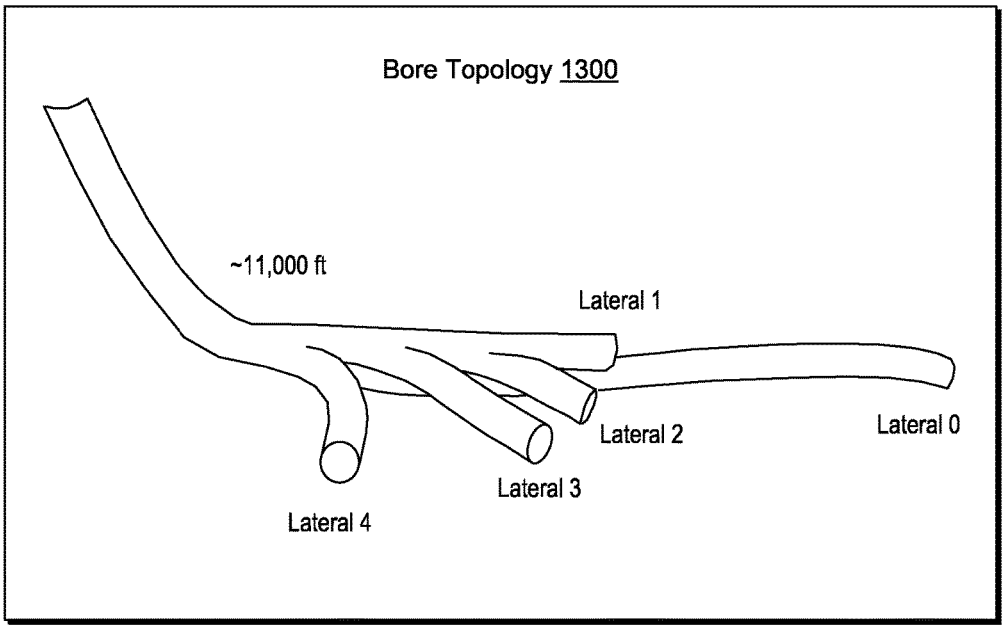
FIG. 13 illustrates an example of bore topology that includes a plurality of lateral bores.

FIG. 13 shows an example of a bore topology 1300 within a formation (e.g., within a geologic environment) where the bore topology 1300 includes a plurality of lateral bores, illustrated as lateral 0, lateral 1, lateral 2, lateral 3 and lateral 4 that extend from a bore at a junction with a spatial dimension (e.g., bore depth) of about 11,000 ft (e.g., about 3350 m).

Figure 14:
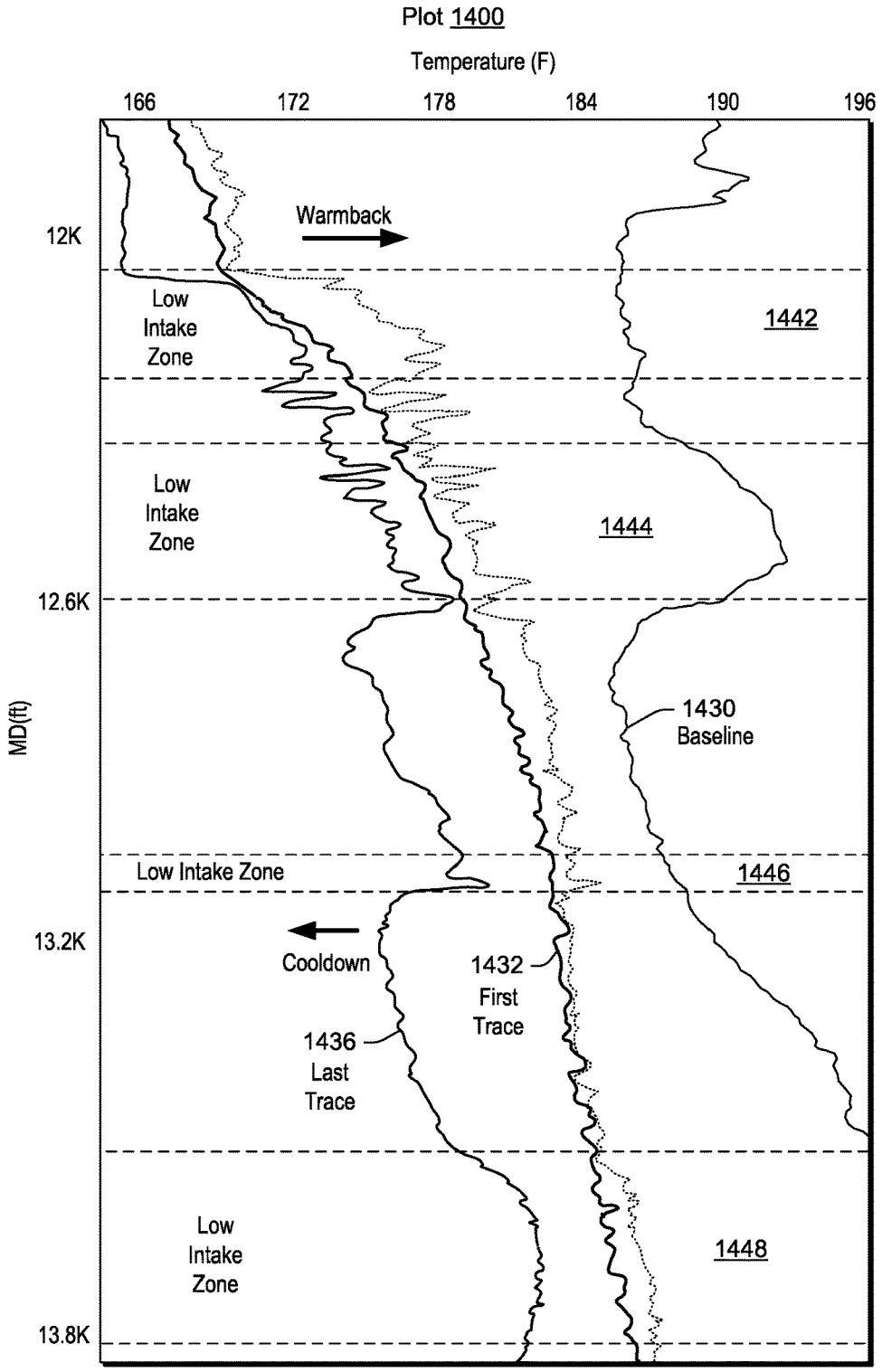
FIG. 14 illustrates an example of a plot of temperature values versus a spatial dimension and values derived from pressure information versus the spatial dimension.

FIG. 14 shows an example plot 1400 that includes a baseline temperature profile 1430 and real-time PTA traces 1432 and 1436 versus a spatial dimension (e.g., bore depth) for the lateral 4 of the bore topology 1300 of FIG. 13. As shown in the plot 1400, real-time PTA traces may be acquired for various positions (e.g., depths), for example, from about 12,000 ft (e.g., about 3650 m) to about 14,000 ft (e.g., about 4300 m). In the example plot 1400, the temperature profile 1430 is a baseline profile that can be used to characterize geothermal effects of the formation while the PTA trace 1432 is a first trace profile and the PTA trace 1436 is a last trace profile.

The plot 1400 also illustrates low intake zones 1442, 1444, 1446 and 1448, which are "low intake" in comparison to various other regions of the bore identified as lateral 4 in the bore topology 1300 of FIG. 13.

The information in the plot 1400 demonstrates how a PTA approach can allow for real-time assessment of one or more regions of a bore. Such information may be acquired at different times, stages, etc. for a bore or bores. As an example, such information may be compared to temperature information, if available.

FIG. 15 shows an example of a table 1500 that includes data with respect to a spatial dimension (e.g., depth) prior to delivery of a treatment and after delivery of a treatment. The data of the table 1500 correspond to the bore labeled lateral 4 of the bore topology 1300 of FIG. 13 where the spatial dimension (e.g., depth) is ordered from furthest (e.g., about 14,000 ft or about 4270 m) to closest (e.g., about 12,000 ft or about 3660 m). In the table 1500, Pinj and Pinj' are the stabilized injection pressures pre-treatment and post-treatment and S and S' are the ISE values based at least in part on the corresponding stabilized injection pressures. As indicated in the table 1500, the treatment has altered the ISE values substantially (see, e.g., the S % column of the table 1500) over a range of about 13,000 ft (e.g., about 3960 m) to about 13,400 ft (e.g., about 4080 m).

Figure 16:
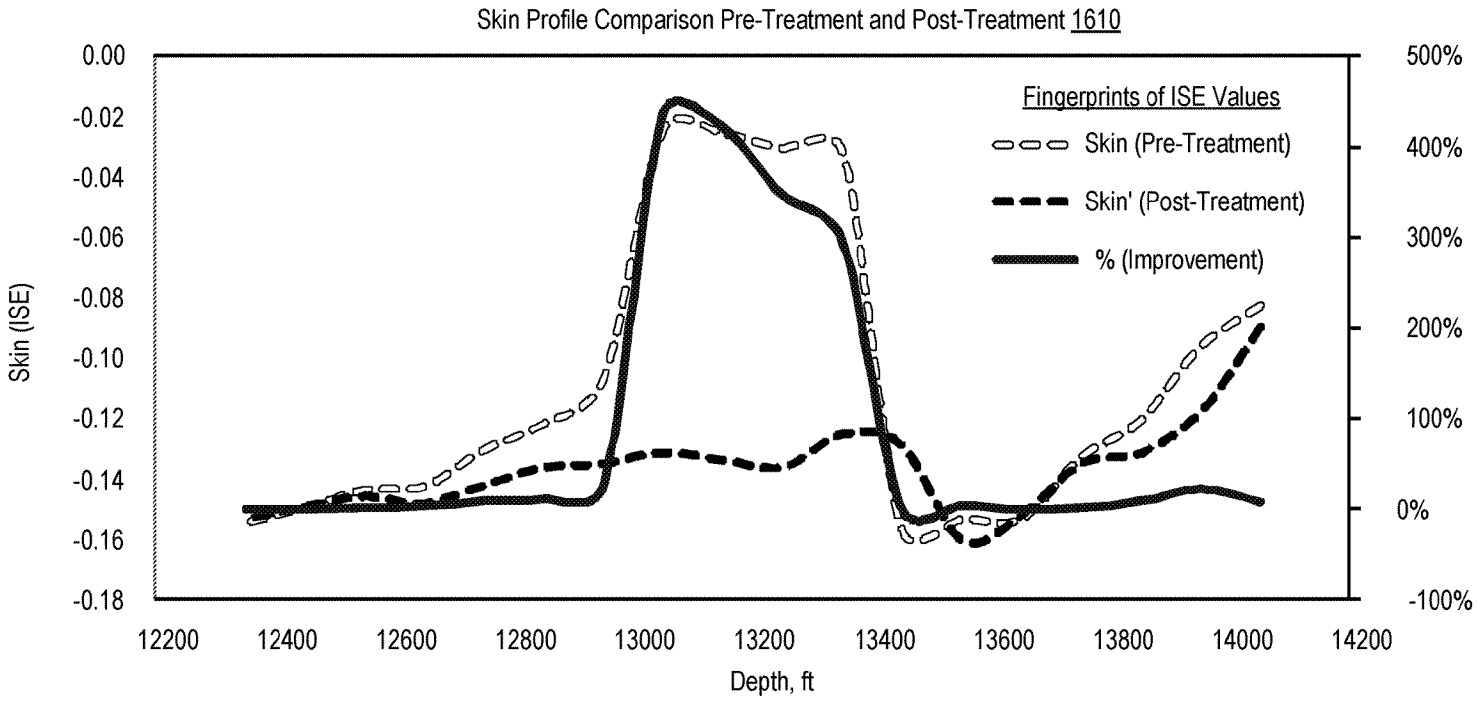
FIG. 16 illustrates an example of a plot and a table that include data for pre-treatment and post-treatment scenarios.

FIG. 16 shows an example of a plot 1610 of skin profiles pre-treatment and post-treatment from the table 1500 of FIG. 15 and a table of pre-treatment and post-treatment data 1660. The skin profiles of the plot 1610 are fingerprints of ISE values versus depth. As indicated, the plot 1610 spans a spatial range from about 12,000 ft (e.g., about 3660 m) to about 14,000 ft (e.g., about 4270 m), again, with respect to the bore labeled lateral 4 in the bore topology 1300 of FIG. 13.

In FIG. 16, the plot 1600 shows a skin reduction in a region of the formation associated with the bore labeled lateral 4 of the bore topology 1300 of FIG. 13. The skin reduction is of the order of hundreds of percent (e.g., as much as 400% or more). In this region, as indicated in the table 1660, KH was increased from about 500 md-ft to about 960 md-ft. The injectivity index (e.g., QI) for the region is increases substantially due to the treatment causing a reduction in skin. As such, the formation capacity may be increased.

As an example, a method can include receiving formation parameter values associated with a bore of a formation; receiving a pressure stabilization value for fluid flow at a location in the bore of the formation; and, based at least in part on the formation parameter values and the pressure stabilization value, calculating a skin factor value for the location in the bore. In such an example, the formation parameter values can include at least one formation capacity value and/or at least one formation pressure value. As an example, formation parameter values can include at least one calculated formation pressure value that is calculated based at least in part on a plurality of measured formation pressure values. As an example, formation parameter values can include at least one formation capacity value and at least one average formation pressure value.

As an example, a pressure stabilization value may be a relatively constant pressure value with respect to time as measured during flow of fluid at a location in a bore. As an example, a method can include receiving a plurality of pressure stabilization values for fluid flow at a plurality of locations in a bore of a formation and calculating a plurality of skin factor values for the plurality of locations in the bore. Such a method may further include storing the plurality of skin factor values as a fingerprint that characterizes the bore. Such a fingerprint may optionally be compared to one or more other fingerprints, for example, as may be associated with other bores. As an example, a bore may be a lateral. As an example, a plurality of laterals may be fluidly coupled to a bore, which may be a main bore that extends to a surface location (e.g., a surface of the Earth). As an example, a plurality of lateral bores may join common bore.

As an example, a method can include receiving distributed temperature survey data for at least a portion of a bore and comparing a skin factor value to at least a portion of the distributed temperature survey data.

As an example, a method can include treating at least a portion of a bore, receiving formation parameter values associated with the treated portion of the bore, receiving a pressure stabilization value for fluid flow at a location in the treated portion of the bore and, based at least in part on the formation parameter values associated with the treated portion of the bore and the pressure stabilization value for fluid flow at the location in the treated portion of the bore, calculating a skin factor value for the location in the treated portion of the bore. In such an example, the method may further include comparing a skin factor value for the location in the bore (e.g., a pre-treatment skin factor value) to the skin factor value for the location in the treated portion of the bore (e.g., a post-treatment skin factor value), for example, where the locations are within a predetermined distance from each other (e.g., where the locations may be approximately the same, for example, within a distance of the order of tens of feet or less).

As an example, a method can include one of a plurality of formation parameter values being a pressure value and calculating a skin factor value at least in part by calculating a difference between the pressure value and a pressure stabilization value.

As an example, a method can include calculating a skin factor value at least in part by implementing at least one of the following equations:

$$S_1 = \frac{KH}{141.2\ Q_2\beta_w\mu_w}\Delta P_S \text{ where } \Delta P_S = P_1 - P_i; \text{ and}$$

$$S_1 = \frac{KH}{141.2\ Q_2\beta_f\mu_f}\Delta P_S \text{ where } \Delta P_S = P_i - P_1.$$

where $S_1$ is the skin factor value, where KH is one of the formation parameter values, where $P_i$ is one of the formation parameter values, where $Q_2$ is the fluid flow rate value of the fluid flow in the bore, where $P_1$ is the pressure stabilization value and where $\beta$ and $\mu$ are fluid properties.

As an example, a system can include a processor (e.g., or processors); memory operatively coupled to the processor (e.g., consider one or more memory circuits, etc.); and instructions stored in the memory and executable by the processor to receive formation parameter values associated with a bore of a formation; receive a pressure stabilization value for fluid flow at a location in the bore of the formation; and, based at least in part on the formation parameter values and the pressure stabilization value, calculate a skin factor value for the location in the bore. In such an example, the system may include instructions to receive a plurality of pressure stabilization values for fluid flow at a plurality of locations in the bore of the formation and instructions to calculate a plurality of skin factor values for the plurality of locations in the bore. Such a method may, for example, include storing the plurality of skin factor values as a fingerprint that characterizes the bore where the bore may be one of a plurality of lateral bores that join a common bore (e.g., directly and/or indirectly).

As an example, a system may include instructions executable to receive distributed temperature survey data for at least a portion of a bore and instructions to compare a skin factor value to at least a portion of the distributed temperature survey data.

As an example, a system may include instructions executable to implement at least one of the following equations:

$$S_1 = \frac{KH}{141.2\ Q_2\beta_w\mu_w}\Delta P_S \text{ where } \Delta P_S = P_1 - P_i; \text{ and}$$

$$S_1 = \frac{KH}{141.2\ Q_2\beta_f\mu_f}\Delta P_S \text{ where } \Delta P_S = P_i - P_1.$$

where $S_1$ is the skin factor value, where KH is one of the formation parameter values, where $P_i$ is one of the formation parameter values, where $Q_2$ is the fluid flow rate value of the fluid flow in the bore, where $P_1$ is the pressure stabilization value and where β and μ are fluid properties.

As an example, one or more computer-readable media can include processor-executable instructions that instruct a computing device where the instructions include instructions to instruct the computing device to: receive formation parameter values associated with a bore of a formation; receive a pressure stabilization value for fluid flow at a location in the bore of the formation; and, based at least in part on the formation parameter values and the pressure stabilization value, calculate a skin factor value for the location in the bore. In such an example, instructions may be included to receive a plurality of pressure stabilization values for fluid flow at a plurality of locations in the bore of the formation and instructions to calculate a plurality of skin factor values for the plurality of locations in the bore. As an example, instructions may include instructions for storing a plurality of skin factor values as a fingerprint that characterizes a bore where, for example, the bore is one of a plurality of lateral bores that join a common bore (e.g., directly and/or indirectly).

As an example, a method may include disposing a tool at a first location in a bore in a geologic environment that includes a reservoir; for an injection time period, injecting fluid in the bore where the fluid achieves a first flow rate at the first location; for a fall-off time period, acquiring pressure information at the first location; determining an average reservoir pressure and a formation capacity based at least in part on the acquired pressure information at the first location; moving the tool to a second location in the bore; injecting fluid in the bore where the fluid achieves a second flow rate at the second location; acquiring pressure information at the second location; and responsive to stabilization of pressure at the second location, based at least in part on the pressure information, calculating a skin factor value for the second location. Such a method may include performing a pressure transient analysis (PTA) based at least in part on the pressure information acquired at the first location.

As an example, a method may include repeating actions for multiple locations in a bore. As an example, a bore may be or include a lateral bore. As an example, a method may be repeated for one or more bores in an environment.

As an example, a method may include performing stimulation. As an example, a skin factor value at a location (e.g., or values at locations) may indicate an effectiveness of the stimulation in the geologic environment (e.g., at or proximate to a location or locations).

As an example, stimulation may include fracturing a geologic environment to generate at least one flow path in a reservoir.

As an example, a tool may be operatively coupled to coil tubing.

As an example, a method may include disposing a tool at a first location in a bore in a geologic environment that includes a reservoir; for a drawdown time period, flowing fluid in the bore where the fluid flows at a first flow rate at the first location; for a build-up time period, acquiring pressure information at the first location; determining an average reservoir pressure and a formation capacity based at least in part on the acquired pressure information at the first location; moving the tool to a second location in the bore; flowing fluid in the bore where the fluid flows at a second flow rate at the second location; acquiring pressure information at the second location; and responsive to stabilization of pressure at the second location, based at least in part on the pressure information, calculating a skin factor value for the second location. Such a method may include performing a pressure transient analysis (PTA) based at least in part on the pressure information acquired at the first location.

As an example, a system may include a processor; memory operatively coupled to the processor; and instructions stored in the memory and executable by the processor to calculate a skin factor value based at least in part on pressure information acquired at a location in a bore of a geologic environment during flow of fluid at that location and during stimulation of the geologic environment where the stimulation is delivered at least in part via the bore. As an example, a formation parameter value may be a pressure value and instructions may include instructions to calculate a skin factor value where the instructions include instructions to calculate a difference between the pressure value and a pressure stabilization value. As an example, a system may include instructions to implement at least one of the following equations:

$$S_1 = \frac{KH}{141.2\ Q_2\beta_w\mu_w}\Delta P_S \text{ where } \Delta P_S = P_1 - P_i; \text{ and}$$

$$S_1 = \frac{KH}{141.2\ Q_2\beta_f\mu_f}\Delta P_S \text{ where } \Delta P_S = P_i - P_1.$$

As an example, one or more methods described herein may include associated computer-readable storage media (CRM) blocks. Such blocks can include instructions suitable for execution by one or more processors (or cores) to instruct a computing device or system to perform one or more actions.

According to an embodiment, one or more computer-readable media may include computer-executable instructions to instruct a computing system to output information for controlling a process. For example, such instructions may provide for output to sensing process, an injection process, drilling process, an extraction process, an extrusion process, a pumping process, a heating process, etc.

Figure 17:
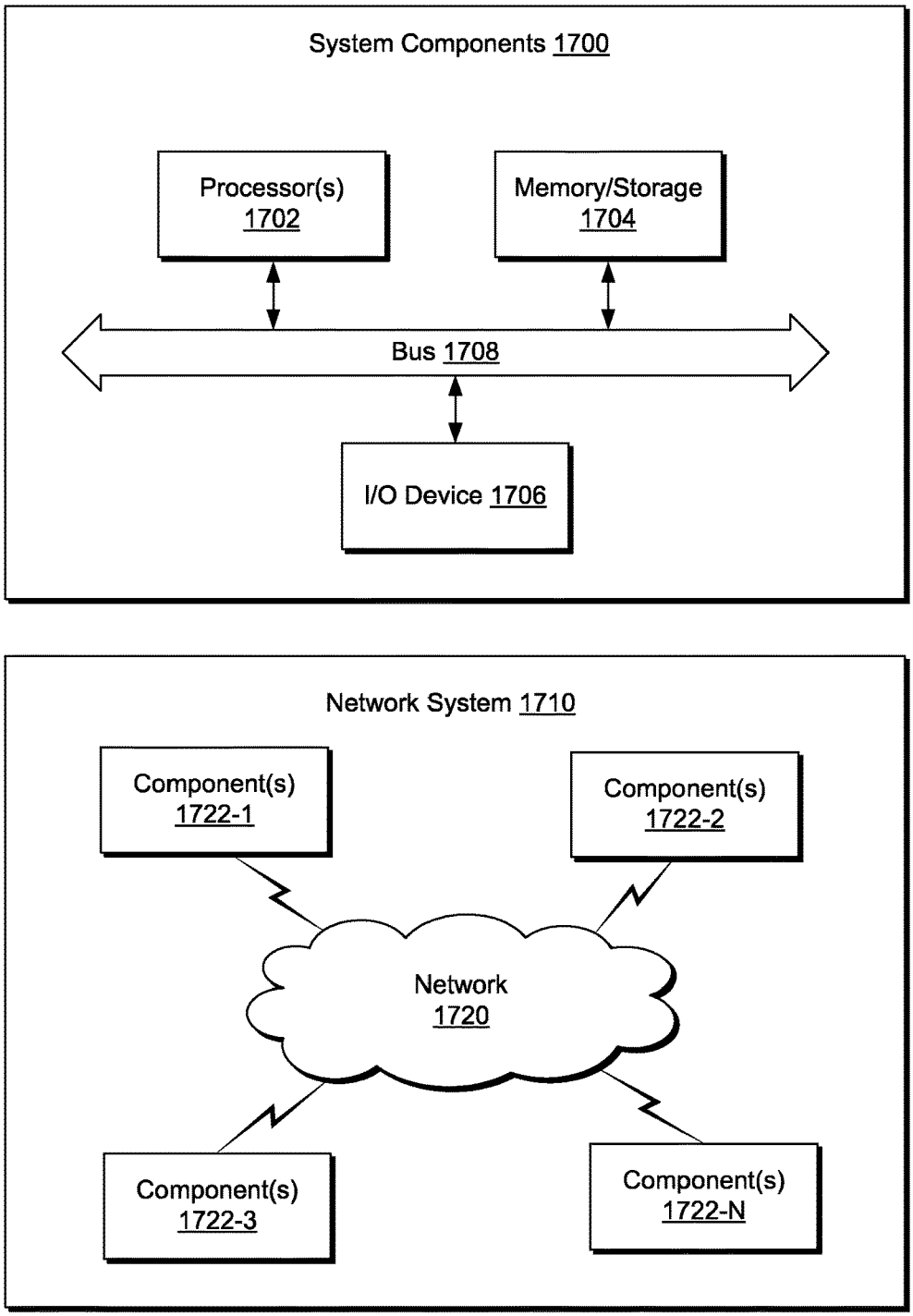
FIG. 17 illustrates example components of a system and a networked system.

FIG. 17 shows components of a computing system 1700 and a networked system 1710. The system 1700 includes one or more processors 1702, memory and/or storage components 1704, one or more input and/or output devices 1706 and a bus 1708. According to an embodiment, instructions may be stored in one or more computer-readable media (e.g., memory/storage components 1704). Such instructions may be read by one or more processors (e.g., the processor(s) 1702) via a communication bus (e.g., the bus 1708), which may be wired or wireless. The one or more processors may execute such instructions to implement (wholly or in part) one or more attributes (e.g., as part of a method). A user may view output from and interact with a process via an I/O device (e.g., the device 1706). According to an embodiment, a computer-readable medium may be a storage component such as a physical memory storage device, for example, a chip, a chip on a package, a memory card, etc.

According to an embodiment, components may be distributed, such as in the network system 1710. The network system 1710 includes components 1722-1, 1722-2, 1722-3, . . . 1722-N. For example, the components 1722-1 may include the processor(s) 1702 while the component(s) 1722-3 may include memory accessible by the processor(s) 1702. Further, the component(s) 1702-2 may include an I/O device for display and optionally interaction with a method. The network may be or include the Internet, an intranet, a cellular network, a satellite network, etc.

As an example, a device may be a mobile device that includes one or more network interfaces for communication of information. For example, a mobile device may include a wireless network interface (e.g., operable via IEEE 802.11, ETSI GSM, BLUETOOTH®, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A method comprising:

receiving formation parameter values associated with a bore of a formation as determined at a first location in the bore via a pressure transient analysis of a test performed by tubing that is operatively coupled to a tool that includes at least one pressure sensor;

receiving a pressure stabilization value for fluid flow via the tubing as measured by the tool at a second location in the bore of the formation; and based at least in part on the formation parameter values and the pressure stabilization value, calculating a skin factor value for the second location in the bore.

2. The method of claim 1 wherein the formation parameter values comprise at least one formation capacity value.

3. The method of claim 1 wherein the formation parameter values comprise at least one calculated formation pressure value that is calculated based at least in part on a plurality of measured formation pressure values.

4. The method of claim 1 wherein the formation parameter values comprise at least one formation capacity value and at least one average formation pressure value.

5. The method of claim 1 wherein the pressure stabilization value comprises a relatively constant pressure value with respect to time as measured during flow of fluid at the second location in the bore.

6. The method of claim 1 further comprising receiving a plurality of pressure stabilization values for fluid flow at a plurality of locations in the bore of the formation and calculating a plurality of skin factor values for the plurality of locations in the bore.

7. The method of claim 6 further comprising storing the plurality of skin factor values as a fingerprint that characterizes the bore.

8. The method of claim 1 wherein the bore comprises one of a plurality of lateral bores that join a common bore.

9. The method of claim 1 further comprising receiving distributed temperature survey data for at least a portion of the bore and comparing the skin factor value to at least a portion of the distributed temperature survey data.

10. The method of claim 1 further comprising treating at least a portion of the bore, receiving formation parameter values associated with the treated portion of the bore, receiving a pressure stabilization value for fluid flow at a location in the treated portion of the bore and, based at least in part on the formation parameter values associated with the treated portion of the bore and the pressure stabilization value for fluid flow at the location in the treated portion of the bore, calculating a skin factor value for the location in the treated portion of the bore.

11. The method of claim 10 further comprising comparing the skin factor value for the location in the bore to the skin factor value for the location in the treated portion of the bore wherein the locations are within a predetermined distance from each other.

12. The method of claim 1 wherein one of the formation parameter values comprises a pressure value and wherein calculating the skin factor value comprises calculating a difference between the pressure value and the pressure stabilization value.

13. A system comprising:

a processor;

memory operatively coupled to the processor; and instructions stored in the memory and executable by the processor to receive formation parameter values associated with a bore of a formation as determined at a first location in the bore via a pressure transient analysis of a test performed by tubing that is operatively coupled to a tool that includes at least one pressure sensor;

receive a pressure stabilization value for fluid flow via the tubing as measured by the tool at a second location in the bore of the formation; and based at least in part on the formation parameter values and the pressure stabilization value, calculate a skin factor value for the second location in the bore.

14. The system of claim 13 further comprising instructions to receive a plurality of pressure stabilization values for fluid flow at a plurality of locations in the bore of the formation and instructions to calculate a plurality of skin factor values for the plurality of locations in the bore.

15. The system of claim 14 further comprising instructions to store the plurality of skin factor values as a fingerprint that characterizes the bore wherein the bore comprises one of a plurality of lateral bores that join a common bore.

16. The system of claim 13 further comprising instructions to receive distributed temperature survey data for at least a portion of the bore and instructions to compare the skin factor value to at least a portion of the distributed temperature survey data.

17. The system of claim 13 wherein one of the formation parameter values comprises a pressure value and wherein the instructions to calculate a skin factor value comprise instructions to calculate a difference between the pressure value and the pressure stabilization value.

18. One or more computer-readable media that comprise processor-executable instructions that instruct a computing device wherein the instructions comprise instructions to instruct the computing device to:

receive formation parameter values associated with a bore of a formation as determined at a first location in the bore via a pressure transient analysis of a test performed by tubing that is operatively coupled to a tool that includes at least one pressure sensor;

receive a pressure stabilization value for fluid flow via the tubing as measured by the tool at a second location in the bore of the formation; and based at least in part on the formation parameter values and the pressure stabilization value, calculate a skin factor value for the second location in the bore.

19. The one or more computer-readable media of claim 18 further comprising instructions to receive a plurality of pressure stabilization values for fluid flow at a plurality of locations in the bore of the formation and instructions to calculate a plurality of skin factor values for the plurality of locations in the bore.

20. The one or more computer-readable media of claim 19 further comprising instructions to store the plurality of skin factor values as a fingerprint that characterizes the bore wherein the bore comprises one of a plurality of lateral bores that join a common bore.

* * * * *